US008395878B2

(12) United States Patent
Stewart et al.

(10) Patent No.: US 8,395,878 B2
(45) Date of Patent: Mar. 12, 2013

(54) METHODS OF CONTROLLING COMPONENTS OF BLASTING APPARATUSES, BLASTING APPARATUSES, AND COMPONENTS THEREOF

(75) Inventors: Ronald F. Stewart, Navan (CA); Michael J. McCann, Chadds Ford, PA (US)

(73) Assignee: Orica Explosives Technology Pty Ltd, Melbourne, Victoria (AU)

( * ) Notice: Subject to any disclaimer, the term of this patent is extended or adjusted under 35 U.S.C. 154(b) by 1659 days.

(21) Appl. No.: 11/790,844

(22) Filed: Apr. 27, 2007

(65) Prior Publication Data

US 2012/0174809 A1 Jul. 12, 2012

Related U.S. Application Data

(60) Provisional application No. 60/795,568, filed on Apr. 28, 2006, provisional application No. 60/813,361, filed on Jun. 14, 2006.

(51) Int. Cl.
*H23Q 7/00* (2006.01)

(52) U.S. Cl. ..... 361/247; 361/248

(58) Field of Classification Search ..... 361/247, 361/249, 251

See application file for complete search history.

(56) References Cited

U.S. PATENT DOCUMENTS

| | | | | |
|---|---|---|---|---|
| 2,499,195 | A | | 2/1950 | McNiven |
| 3,339,204 | A | | 8/1967 | Rail |
| 3,355,736 | A | | 11/1967 | Perper |
| 3,740,488 | A | | 6/1973 | Linfield et al. |
| 3,780,654 | A | * | 12/1973 | Shimizu et al. ..... 102/312 |
| 3,831,138 | A | | 8/1974 | Rammer |
| 3,900,878 | A | | 8/1975 | Tsao |
| 3,967,201 | A | | 6/1976 | Rorden |
| 4,090,135 | A | | 5/1978 | Farstad et al. |
| 4,152,648 | A | | 5/1979 | Delogne |
| 4,208,630 | A | | 6/1980 | Martinez |
| 4,412,339 | A | | 10/1983 | Alfke et al. |
| 4,476,574 | A | | 10/1984 | Struven |
| 4,533,874 | A | | 8/1985 | Fischer |
| 4,576,093 | A | | 3/1986 | Snyder |
| 4,615,268 | A | * | 10/1986 | Nakano et al. ..... 102/217 |
| 4,652,857 | A | | 3/1987 | Meiksin |
| 4,685,396 | A | | 8/1987 | Birse et al. |
| 4,777,652 | A | | 10/1988 | Stolarczyk |
| 4,812,852 | A | | 3/1989 | Bent et al. |
| 4,870,697 | A | | 9/1989 | Weber |

(Continued)

FOREIGN PATENT DOCUMENTS

| | | |
|---|---|---|
| CA | 1295372 | 2/1992 |
| EP | 0 174 115 A2 | 3/1986 |

(Continued)

OTHER PUBLICATIONS

Conti, Ronald S., "Responders to Underground Mine Fires" (1992) http://www.cdc.gov/niosh/mining/pubs/pdfs/rtum.pdf.

(Continued)

*Primary Examiner* — Danny Nguyen

(57) ABSTRACT

Disclosed herein are methods for communicating wireless signals between components of a blasting apparatus, with the intention of conducting a blasting event. In preferred embodiments, the methods are particularly suited to through -rock transmission of wireless command signals, and optionally wireless calibration or synchronization signals, thereby to achieve timed actuation of explosive charges positioned below ground under the control of one or more blasting machines located at or above a surface of the ground, with a high degree of accuracy. Further disclosed are blasting apparatuses and components thereof suitable for use, for example, in conducting the methods of the invention.

41 Claims, 5 Drawing Sheets

U.S. PATENT DOCUMENTS

| | | | | |
|---|---|---|---|---|
| 4,879,755 | A | 11/1989 | Stolarczyk et al. | |
| 4,916,455 | A | 4/1990 | Bent et al. | |
| 4,968,978 | A | 11/1990 | Stolarczyk | |
| 5,093,929 | A | 3/1992 | Stolarczyk et al. | |
| 5,264,795 | A | 11/1993 | Rider | |
| 5,325,095 | A | 6/1994 | Vadnais et al. | |
| 5,453,715 | A | 9/1995 | Lee | |
| 5,469,112 | A | 11/1995 | Lee | |
| 5,499,029 | A | 3/1996 | Bashforth et al. | |
| 5,633,895 | A | 5/1997 | Powell, II et al. | |
| 5,669,065 | A | 9/1997 | Waye et al. | |
| 5,697,067 | A | 12/1997 | Graham et al. | |
| 5,881,310 | A | 3/1999 | Airhart et al. | |
| 5,963,847 | A | 10/1999 | Ito et al. | |
| 6,127,897 | A | 10/2000 | Sasaki | |
| 6,253,679 | B1 | 7/2001 | Woodall et al. | |
| 6,263,189 | B1 | 7/2001 | Reagor | |
| 6,349,214 | B1 | 2/2002 | Braun | |
| 6,349,215 | B1 | 2/2002 | Braun | |
| 6,370,396 | B1 | 4/2002 | Meiksin et al. | |
| 6,408,019 | B1 | 6/2002 | Pickering et al. | |
| 6,489,772 | B1 | 12/2002 | Holladay et al. | |
| 6,813,324 | B1 | 11/2004 | Yewen | |
| 6,885,918 | B2 * | 4/2005 | Harmon et al. | 701/14 |
| 2002/0022451 | A1 | 2/2002 | Waye et al. | |
| 2002/0098867 | A1 | 7/2002 | Meiksin et al. | |
| 2002/0098868 | A1 | 7/2002 | Meiksin et al. | |
| 2003/0000703 | A1 | 1/2003 | Cernocky et al. | |
| 2003/0001753 | A1 | 1/2003 | Cernocky et al. | |
| 2003/0058108 | A1 | 3/2003 | Fling et al. | |
| 2003/0098157 | A1 | 5/2003 | Hales et al. | |
| 2004/0102219 | A1 | 5/2004 | Bunton et al. | |
| 2004/0266497 | A1 | 12/2004 | Reagor et al. | |
| 2005/0079818 | A1 | 4/2005 | Atwater et al. | |
| 2005/0093682 | A1 | 5/2005 | Enguent et al. | |
| 2005/0150697 | A1 | 7/2005 | Altman et al. | |
| 2007/0044673 | A1 | 3/2007 | Hummel et al. | |
| 2008/0156217 | A1 | 7/2008 | Stewart et al. | |
| 2008/0307993 | A1 * | 12/2008 | Chan et al. | 102/214 |

FOREIGN PATENT DOCUMENTS

| | | | |
|---|---|---|---|
| GB | 671188 | A | 4/1952 |
| GB | 1055440 | A | 9/1965 |
| GB | 2019700 | A | 10/1979 |
| GB | 2084430 | A | 4/1982 |
| GB | 2220823 | A | 1/1990 |
| GB | 2385343 | A | 8/2003 |
| WO | WO 01/59401 | A1 | 8/2001 |
| WO | WO 2005/052498 | A1 | 6/2005 |
| WO | WO 2006/047823 | A1 | 5/2006 |
| WO | WO 2006/076777 | A1 | 7/2006 |
| WO | WO 2006/096920 | A1 | 9/2006 |

OTHER PUBLICATIONS

"Any time, any place, anywhere"—World Mining Equipment: Jan. 2000 http://www.accessmylibrary.com/coms2/summary_0286-27531987_ITM.

Flood, D.; Doyle, L.; Nolan, K.; O'Mahony, D.; "Symbol Timing Synchronization in Software Radio Receivers" http://ctvr.ie/docs/Flood_SDRforum_2004.pdf.

Kalkan, Mine, "Zero-Crossing Based Demodulation of Minimum Shift Keying", Turk. J. Elec. Engin., vol. 11, No. 2, 2003 http://journals.tubitak.gov.tr/elektrik/issues/elk-03-11-2/elk-11-2-1-0211-1.pdf.

Chi, Peimin, "Timing and Frequency Synchronization Issues for Narrowband Wireless Communication Systems" http://bwrc.eecs.berkeley.edu/Publications/2002/thesis/timing_freqncy_sync_issues/peimin_msthesis.pdf.

Rajan, Suju and Slatton, K. Clint, "Clustering Methods for Extremely Low Frequency Subsurface Signals", ASPL Report 2004-12-003, 2004 http://www.aspl.ece.ufl.edu/reports/Rep_2004-12-003.pdf.

Bogan, Larry, "Global Positioning System—GPS How It Works", 1998 http://www.go.ednet.ns.ca/~larry/gps/gps_talk.html.

National Institute for Occupational Safety and Health (NIOSH), "Evalution of a Signaling and Warning System for Underground Mines", RI 9641, 1997 http://www.cdc.gov/niosh/mining/pubs/pdfs/ri9641.pdf.

Sarteel, F.; Delogne, Paul; Deryck, Louis, "Les communications par radio les tunnels routiers", Revue HF, SITEL, vol. XI, 1980, pp. 221-239.

Office of Industrial Technologies, Mining Project Fact Sheet—"Wireless Telemetry for Mine Monitoring and Emergency Communications" http://www.p2pays.org/ref/08/07409.pdf (Created: Feb. 3, 1999; Modified: May 6, 2008).

Office of Industrial Technologies, Mining Project Fact Sheet—"High Temperature Superconductors in Comunications" http://www.dep.state.pa.us/dep/deputate/pollprev/techservices/paiof/PAIOFActivities/programs/PDF/Mining/htswireless.pdf (Created: Jun. 27, 2001; Modified: Jun. 27, 2001).

Industrial Technologies Program, "Wireless Mine-Wide Telecommunications" http://www.netl.doe.gov/keyissues/mining/wireless2.pdf (Created: Jun. 12, 2006; Modified: Jun. 12, 2006).

Industrial Technologies Program, "Through-the-Earth Communications for the Mining Industry" http://www.netl.doe.gov/keyissues/mining/communication.pdf (Created: May 1, 2006; Modified: Jun. 9, 2006).

Chirdon, "Investigate Mine Site Technologies PED and TRACKER systems" http://www.nrcce.wvu.edu/energyforum/docs/Chirdon.pdf (Created: Mar. 3, 2006; Modified: Mar. 3, 2006).

Mine Radio Systems Inc.—Mine Radio Systems (MRS) http://www.infomine.com/index/suppliers/Mine_Radio_Systems_Inc._(MRS).html (Created: Aug. 28, 2008).

Varis Smart Underground Communications http://www.varismine.com/news/ReviewOfMineCommunicationsJan2006.pdf (Created: Jan. 26, 2006; Modified: Jan. 26, 2006) Products: Smart Blast—http://www.varismine.com/products/smartblast/smartblast.php (Created: Dec. 19, 2004) Smart Com—Leaky Feeder and Ethernet Communications System—http://www.varismine.com/products/smartcom/smartcom.php (Created: Mar. 1, 2005).

Rockwell, Mark, "Taking Communications Underground", Wireless Week, Feb. 15, 2006 http://www.wirelessweek.com/article.aspx?id=111700 (Created: Mar. 3, 2007).

Configurable logic for wireless communications: carrier and symbol synchronization http://www.eetasia.com/ARTICLES/2000SEP/2000SEP27_PL_NTEK_RFD_TAC.PDF (Created: Oct. 9, 2000; Modified: Oct. 9, 2000).

Unitronics http://www.unitronics.com http://www.unitronics.com/m90side.htm (Created: Jan. 31, 2001).

The Holmes Safety Association Bulletin, Sep. 1997 http://www.msha.gov/PROGRAMS/HSAPUBS/1997/SEPT97.pdf (Created: Oct. 1, 1997; Modified: Nov. 8, 2007).

TG MinerTrack—Information for MSHA regarding communications to trapped miners. http://www.gsimining.com/TGminertrack.htm (Created: Jul. 19, 2007).

Overnight market: Suddenly mine safety manufacturers overwhelmed, Feb. 2006 http://www.tmcnet.com/usubmit/2006/02/05/1343240.htm (Created: Feb. 5, 2006).

"Blasting without firing cables"—World Mining Equipment: Sep. 1995, vol. 19, Issue 7, pp. 19-20, Abstract. https://www.etde.org/etdeweb/details.jsp?query_id=0&page=0&osti_id=158078&Row=0 (Created Sep. 1, 1995).

Conti, Ronald S. and Chasko, Linda L., "Technologies for today's mine emergency responders", Int. J. Emergency Management, vol. 1, No. 1, 2001, pp. 13-29. http://www.inderscience.com/search/index.php?action=record&rec_id=506&prevQuery=&ps=10&m=or (no date available).

Pittman, Walter E., Jr., "Through the earth radio communications for trapped miners", Earth Sciences History, vol. 3, No. 2, 1984. http://www.metapress.com/content/5j1xw52181q14x85/?p=0b97db79297147a3b0c950c9e54d5dd6&pi=0. (Created: Nov. 5, 2007).

Large, D.; Ball, L.; Farstad, A., "Radio Transmission to and from Underground Coal Mines—Theory and Measurement", IEEE Transactions on Communications, Mar. 1973, vol. 21, Issue 3, pp. 194-202.

Zhang, Y.P.; Zheng, G.X.; Sheng, J.H., "Radio propagation at 900 MHz in underground coal mines", IEEE Transactions on Antennas and Propagation, May 2001, vol. 49, No. 5, pp. 757-762.

Raab, F.H., "Signal-processing receiver for through-the-earth communication", Military Communications Conference, 1993, MILCOM '93, Conference record, 'Communications on the Move', IEEE, Oct. 11-14, 1993, vol. 2, pp. 619-623.
Sogade, J.; Vichabian, Y.; Vandiver, A., Reppert, P.M., Coles, D., Morgan, F.D., "Electromagnetic cave-to-surface mapping system", IEEE Transactions on Geoscience and Remote Sensing, Apr. 2004, vol. 42, Issue 4, pp. 754-763.
Meiksin, Zvi H., "Wireless Mine-Wide Telecommunications Technology", Mar. 1, 2004, Transtek, Inc. (US). http://www.osti.gov/bridge/servlets/purl/828656-IUdFCs/native/.
Meiksin, Zvi H., "Through-the-Earth (TTE) System and the In-Mine Power Line (IMPL) System", Oct. 1, 2001, Transtek, Inc. (US). http://www.osti.gov/bridge/servlets/purl/788109-zYiSJs/native/.
Meiksin, Zvi H., "Wireless Mine Wide Telecommunication Technology", Oct. 1, 2002, Transtek, Inc. (US). http://www.osti.gov/bridge/servlets/purl/820022-ofEb9t/native/.
Meikson, Zvi H., "Research, Development, and Experiemental Telecommunications Technology", Jul. 1, 2002, Transtek, Inc. (US). http://www.osti.gov/bridge/servlets/purl/800762-3zcBem/native/.
Meiksin, Zvi H., "Development of a Comprehensive Wireless Communications System for the Underground Mining Industry", Apr. 1, 2001, Transtek, Inc. (US). http://www.osti.gov/bridge/servlets/purl/815212-xzOKcA/native/.
Meiksin, Zvi H., "Wireless Mine Wide Telecommunications Technology", Apr. 1, 2002, Transtek, Inc. (US). http://www.osti.gov/bridge/servlets/purl/793665-HimSVH/native/.
Meiksin, Zvi H., "Wireless Mine-Wide Telecommunications Technology", Jan. 1, 2003, Transtek, Inc. (US). http://www.osti.gov/bridge/servlets/purl/822231-oggVG1/native/.
Meiksin, Zvi H., "Wireless Mine-Wide Telecommunications Technology", Jan. 1, 2004, Transtek, Inc. (US). http://www.osti.gov/bridge/servlets/purl/822690-hn5Q7l/native/.
Meiksin, Zvi H., "Quarterly Technical Report for In-Mine (IM) System", Jul. 1, 2001, Transtek, Inc. (US). http://www.osti.gov/bridge/servlets/purl/785123-b6emUl/native/.
Meiksin, Zvi H., "Through-the-Earth (TTE) Communications System and the In-Mine Power Line (IMPL) Communications System", Jan. 1, 2002, Transtek, Inc. (US). http://www.osti.gov/bridge/servlets/purl/790783-Y8esLX/native/.
Durkin, J., "Study of through-the-earth communications", Dissertation Abstracts International Part B: Science and Engineering, vol. 44, No. 8, 1984, pp. 327, Abstract. http://md1.csa.com/partners/viewrecord.php?requester=gs&collection=TRD&recid=0809226EA.
Buettner, H.M.; Didwall, E.M.; Bukofzer, D.C., "Through-the-earth communication: Experiment results from Billie Mine and Mississippi Chemical Mine", Abstract, May 2006. http://md1.csa.com/partners/viewrecord.php?requester=gs&collection=TRD&recid=N8911072AH.
Meiksin, Z.H., "Industrial Prototype Modules for Wireless Through-the-Earth Communication", 2002, Abstract. http://md1.csa.com/partners/viewrecord.php?requester=gs&collection=TRD&recid=N0235511AH.
Mine Site Technologies Pty Limited (MST), Communications Systems Specialists http://www.infomine.com /index/suppliers/Mine_Site_Technologies_Pty_Limited_(MST).html, Dec. 15, 2008.
Mine Site Technologies Pty Limited—Blast PED—system overview. www.minesite.com.au/coal_mines_blastped_system, Dec. 15, 2008.
Mine Site Technologies Pty Limited—"PED saves lives, saves costs", http://www.minesite.com.au/download/file/337/PED_Brochure.pdf, Dec. 15, 2008.
Mine Site Technologies Pty Limited—FAQs http://www.minesite.com.au/frequently_asked_questions, Dec. 15, 2008.
Mine Site Technologies Pty Limited—PED System—overview. http://www.minesite.com.au/coal_mines_ped_system, Dec. 15, 2008.
Mine Site Technologies Pty Limited—BlastPED System—PED Version. http://www.minesite.com.au/ped_version, Dec. 15, 2008.
Mine Site Technologies Pty Limited—BlastPED System—LF Version. http://www.minesite.com.au/lf_version, Dec. 15, 2008.
Mine Site Technologies Pty Limited—BlastPED System—EXEL/ST Version. http://www.minesite.com.au/exel_version, Dec. 15, 2008.
Rockwell, Mark, "Taking Communications Underground", Wireless Week, Feb. 15, 2006 http://www.wirelessweek.com/article.aspx?id=111700.
Configurable logic for wireless communications: carrier and symbol synchronization http://www.eetasia.com/ARTICLES/2000SEP/2000SEP27_PL_NTEK_RFD_TAC.PDF.
The Holmes Safety Association Bulletin, Sep. 1997 http://www.msha.gov/PROGRAMS/HSAPUBS/1997/SEPT97.pdf.
Overnight market: Suddenly mine safety manufacturers overwhelmed, Feb. 2006 http://www.tmcnet.com/usubmit/2006/02/05/1343240.htm.
"Blasting without firing cables"—World Mining Equipment: Sep. 1995, vol. 19, Issue 7, pp. 19-20, Abstract. https://www.etde.org/etdeweb/details.jsp?query_id=0&page=0&osti_id=158078&Row=0.
Conti, Ronald S. and Chasko, Linda L., "Technologies for today's mine emergency responders", Int. J. Emergency Management, vol. 1, No. 1, 2001, pp. 13-29. http://www.inderscience.com/search/index.php=action=record&rec_id=506&prevQuery=&ps=10&m=or.
Pittman, Walter E., Jr., "Through the earth radio communications for trapped miners", Earth Sciences History, vol. 3, No. 2, 1984. http://www.metapress.com/content/5j1xw52181q14x85/?p=0b97db79297147a3b0c950c9e54d5dd6&pi=0.
Raab, F.H., "Signal-processing receiver for through-the-earth communication", Military Communications Conference, 1993, MILCOM '93 , Conference record, 'Communications on the Move', IEEE, Oct. 11-14, 1993, vol. 2, pp. 619-623.
Meiksin, Zvi H., "Wireless Mine-Wide Telecommunications Technology", Mar. 1, 2004, Transtek, Inc. (US). http://www.osti.gov/bridge/servlets/purl/828656-lUdFCs/native/.
Meiksin, Zvi H., "Research, Development, and Experimental Telecommunications Technology", Jul. 1, 2002, Transtek, Inc. (US). http://www.osti.gov/bridge/servlets/purl/800762-3zcBem/native/.
Mine Site Technologies Pty Limited (MST), Communications Systems Specialists http://www.infomine.com/index/suppliers/Mine_Site_Technologies_Pty_Limited_(MST).html, Dec. 15, 2008.
Mine Site Technologies Pty Limited—"PED saves lives, saves costs". http://www.minesite.com.au/download/file/337/PED_Brochure.pdf, Dec. 15, 2008.
Mine Site Technologies Pty Limited—PED System—overview. http://www.minesite.com.au/coal_mines_ped_system, Dec, 15, 2008.
Patent Abstracts of Japan; 04-000945; "MSK Demodulator"; Jan. 6, 1992; Asahi Kasei Micro Syst KK.
Patent Abstracts of Japan; 11-098107; "Spread Spectrum Communication Type Receiver"; Apr. 9, 1999; Kokusai Electric Co. Ltd.
Patent Abstracts of Japan; 57-106882; "Data Transmitting Device"; Jul. 2, 1982; Japanese National Railways, Mitsubishi Electric Corp.
Patent Abstracts of Japan; 2000-286910; "Digital Demodulator"; Oct. 13, 2000; Fujitsu General Ltd.
Patent Abstracts of Japan; 2001-007878; "Digital Demodulator"; Jan. 12, 2001; Fujitsu General Ltd.
Patent Abstracts of Japan; 2001-103559; "Digital Mobile Communication System and Its Wireless Relay Station Device"; Apr. 13, 2001; Hitachi Kokusai Electric Inc.
Patent Abstracts of Japan; 2004-096182; "Underwater or Underground Communication Apparatus"; Mar. 25, 2004; Reideikku:KK, Sakata Denki.
Patent Abstracts of Japan; 02-159856; "FSK Modulated Signal Demodulation Circuit"; Jun. 20, 1990; Seiko Epson Corp.
Patent Abstracts of Japan; 06-291791; "Demodulator for Phase Modulation Wave Signal"; Oct. 18, 1994; Toshiba Corp., Toshiba Ave. Corp.
Patent Abstracts of Japan; 57-210750; "FSK Signal Demodulating System"; Dec. 24, 1982; Fujitsu Ltd.
Patent Abstracts of Japan; 60-196021; "Calling Device Using Cable Shielding Layer as Transmission Line"; Oct. 4, 1985; Toko Denki KK.
Patent Abstracts of Japan; 10-075191; "Receiver with Antenna Booster"; Mar. 17, 1998; Kenwood Corp.

Patent Abstracts of Japan; 10-239000; "Remote Triggering Device"; Sep. 11, 1998; Ishikawa Seisakusho Ltd.
Chinese Patent Abstract; CN1144425 A; "Soil Carrier Broadcast and Communication System"; Mar. 5, 1997; Li Wanliang.
Chinese Patent Abstract; CN1148312 A; "Under-ground and above-ground"; Apr. 23, 1997; Lu Yumin.
Russian Patent Abstract; esp@cenet; RU2112146 C1; "Device of Wireless Emergency Call and Technological Information Mine Signalling and Communication System"; May 27, 1998; Kolupaev, N.A. et al.
Russian Patent Abstract; esp@cenet; RU2131515 C1; "Device for Wireless Emergency and Production Process Signalling and Communication"; Jun. 10, 1999; Kolupaev, N.A. et al.
Russian Patent Abstract; esp@cenet; RU2158368 C1; "Device for On-Line Wireless Communication with Underground Mine Workings"; Oct. 27, 2000; Drabkin, A.L. et al.
Russian Patent Abstract; esp@cenet; RU2221149 C1; "Method of Transmission of Messages to Underground Workings"; Jan. 10, 2004; Volynskij, D.N. et al.
Raab, F.H., Joughin, I.R., "Signal Processing for Through-The-Earth Radio Communication", IEEE Transactions on Communications, vol. 43, Issue:12, Dec. 1995.
Raab, F.H., "Signal Processing for Through-The-Earth Electromagnetic Systems", IEEE Transactions on Industry Applications, vol. 24, Issue:2, Mar./Apr. 1988.
Conti, Ronald S., "Responders to Underground Mine Fires" (1992) http://www.cdc.gov/niosh/mining/pubs/pdfs/rtum.pdf (Created: Nov. 7, 2001; Modified Aug. 24, 2005).
"Any time, any place, anywhere"—World Mining Equipment: Jan. 2000 http://www.business.highbeam.com/4879/article-1G1-60020583/any-time-any-place-anywhere (Created: Jan. 1, 2000).
Flood, D.; Doyle, L.; Nolan, K.; O'Mahony, D.; "Symbol Timing Synchronization in Software Radio Receivers" http://www.tara.tcd.ie/bitstream/2262/29864/1/SYMBOL%20TIMING.pdf (Created: Oct. 2, 2004 12:07:44; Modified: Oct. 2, 2004 17:28:59).
Flood, D.; Doyle, L.; MacKenzie, K.; Nolan, K.; "A Noise Adaptive Symbol Timing Synchronization Algorithm for Software Radio Receivers" http://www.tara.tcd.ie/bitstream/2262/29861/1/a%20flood.pdf (Created: May 6, 2009 13:25:17; Modified: May 6, 2009 13:25:17).
Kalkan, Mine, "Zero-Crossing Based Demodulation of Minimum Shift Keying", Turk. J. Elec. Engin., vol. 11, No. 2, 2003 http://journals.tubitak.gov.tr/elektrik/issues/elk-03-11-2/elk-11-2-1-0211-1.pdf (Created: Jun. 17, 2003).
Conti, Ronald S., "Emerging Technologies: Aiding Responders in Mine Emergencies and During the Escape from Smoke-Filled Passageways" http://www.cdc.gov/niosh/mining/pubs/pdfs/etarim.pdf (Created: Feb. 15, 2002; Modified: Jul. 26, 2010).
Chi, Peimin, "Timing and Frequency Synchronization Issues for Narrowband Wireless Communication Systems" http://www.google.ca/url?sa=t&rct=j& q=chi%2C%20peimin%2C%20%E2%80%9Ctiming%20and% 20frequency%20synchronization%20issues%20for%20narrow band%wireless%20communication%20systems%E2%80%9D& source=web& cd=1& ved=0CFAQFjAA& url=http%3A%2F%2Fciteseerx.ist.psu.edu%2Fviewdoc%2Fdownload% 3Fdoi%3D10.1.1.126.8837%26rep%3Drep1% 26type%3Dpdf& ei=mQQIUOj9G4Hn0QGMvMnXAw& usg=AFQjCNGdhzldgGna_a2ka6uw S5N0x4KjWQ&cad=rja (Created: Dec. 21, 2002; Modified: Dec. 21, 2002).
Rajan, Suju and Slatton, K. Clint, "Clustering Methods for Extremely Low Frequency Subsurface Signals", ASPL Report 2004-12-003, 2004 http://www.aspl.ece.ufl.edu/reports/Rep_2004-12-003.pdf (Created: Dec. 30, 2004; Modified: Dec. 30, 2004).
National Institute for Occupational Safety and Health (NIOSH), "Evalution of a Signaling and Warning System for Underground Mines", RI 9641, 1997 http://www.cdc.gov/niosh/mining/pubs/pdfs/ri9641.pdf (Created: Jun. 17, 1997; Modified: Aug. 24, 2005).
Stolarczyk, L.G., "Emergency and operational low and medium frequency band radiocommunications system for underground mines", IEEE Transactions on Industry Applications, Jul./Aug. 1991, vol. 27, Issue 4, pp. 780-790.
Delogne, Paul, "Radio goes underground", IEEE Spectrum, vol. 17, No. 7, Jul. 1980, pp. 26-29.
Sarteel, F.; Delogne, Paul; Deryck, Louis, "Les communications par radio dans les tunnels routiers", Revue HF, SITEL, vol. XI, 1980, pp. 221-239.
Delogne, Paul, "Les télécommunications par radio en milieu souterrain", Revue HF, Belgique, vol. IX, No. 2, 1973, Prix Acta Technica Belgica, 1973, pp. 18-26.
Gappmair, W., "Self-noise performance of zero-crossing and Gardner synchronisers applied to one/two-dimensional modulation schemes", Electronics Letters, Aug. 5, 2004, vol. 40, Issue 16, pp. 1010-1011.
Chung, Kah-Seng, "Underground microcellular communications network", Singapore ICCS 1994 Conference Proceedings, Nov. 14-18, 1994, vol. 1, pp. 343-346.
Chung, Kah-Seng, "A radio communications network for voice and data in undergroundmines", TENCON 2000 Proceedings, vol. 1, pp. 516-521.

* cited by examiner

METHODS OF CONTROLLING COMPONENTS OF BLASTING APPARATUSES, BLASTING APPARATUSES, AND COMPONENTS THEREOF

CROSS-REFERENCE TO RELATED APPLICATIONS

This application claims the priority rights of prior U.S. patent applications Ser. Nos. 60/795,568 filed on Apr. 28, 2006, and 60/813,361 filed on Jun. 14, 2006, both by applicants herein.

FIELD OF THE INVENTION

The invention relates to the field of apparatuses and components thereof, for effecting blasting of rock, which employ wireless communication, and methods of blasting employing such apparatuses and components thereof.

BACKGROUND TO THE INVENTION

In mining operations, the efficient fragmentation and breaking of rock by means of explosive charges demands considerable skill and expertise. In most mining operations explosive charges, including boosters, are placed at predetermined positions near or within the rock. The explosive charges are then actuated via detonators having predetermined time delays, thereby providing a desired pattern of blasting and rock fragmentation. Traditionally, signals are transmitted to the detonators from an associated blasting machine via non-electric systems employing low energy detonating cord (LEDC) or shock tube. Alternatively, electrical wires may be used to transmit more sophisticated signals to and from electronic detonators. For example, such signaling may include ARM, DISARM, and delay time instructions for remote programming of the detonator firing sequence. Moreover, as a security feature, detonators may store firing codes and respond to ARM and FIRE signals only upon receipt of matching firing codes from the blasting machine. Electronic detonators can be programmed with time delays with an accuracy of 1 ms or less.

The establishment of a wired blasting arrangement involves the correct positioning of explosive charges within boreholes in the rock, and the proper connection of wires between an associated blasting machine and the detonators. The process is often labour intensive and highly dependent upon the accuracy and conscientiousness of the blast operator. Importantly, the blast operator must ensure that the detonators are in proper signal transmission relationship with a blasting machine, in such a manner that the blasting machine at least can transmit command signals to control each detonator, and in turn actuate each explosive charge. Inadequate connections between components of the blasting arrangement can lead to loss of communication between blasting machines and detonators, and therefore increased safety concerns. Significant care is required to ensure that the wires run between the detonators and an associated blasting machine without disruption, snagging, damage or other interference that could prevent proper control and operation of the detonator via the attached blasting machine.

Wireless blasting systems offer the potential for circumventing these problems, thereby improving safety at the blast site. By avoiding the use of physical connections (e.g. electrical wires, shock tubes, LEDC, or optical cables) between detonators, and other components at the blast site (e.g. blasting machines) the possibility of improper set-up of the blasting arrangement is reduced. Another advantage of wireless blasting systems relates to facilitation of automated establishment of the explosive charges and associated detonators at the blast site. This may include, for example, automated detonator loading in boreholes, and automated association of a corresponding detonator with each explosive charge, for example involving robotic systems. This would provide dramatic improvements in blast site safety since blast operators would be able to set up the blasting array from entirely remote locations. However, such systems present formidable technological challenges, many of which remain unresolved. One obstacle to automation is the difficulty of robotic manipulation and handling of blast apparatus components at the blast site, particularly where the components require tieing-in or other forms of hook up to electrical wires, shock tubes or the like. Wireless communication between components of the blasting apparatus may help to circumvent such difficulties, and are clearly more amenable to application with automated mining operations.

Progress has been made in the development apparatuses and components for establishment of a wireless blasting apparatus at a blast site. Nonetheless, existing wireless blasting systems still present significant safety concerns, and improvements are required if wireless blasting systems are to become a more viable alternative to traditional "wired" blasting systems.

SUMMARY OF THE INVENTION

It is an object of the present invention, at least in preferred embodiments, to provide a method of blasting through wireless communication with blast apparatus components such as wireless detonator assemblies and/or wireless booster assemblies.

It is another object of the present invention, at least in preferred embodiments, to provide a method of synchronizing wireless detonator assemblies and/or wireless electronic boosters for timed actuation of explosive charges associated therewith.

It is another object of the present invention, at least in preferred embodiments, to provide a blasting apparatus, or a blasting component, suitable for use in achieving timed actuation of explosive charges.

In one aspect the present invention provides a method of communicating at least one wireless command signal from at least one blasting machine to at least one blasting component comprising or in operative association with and explosive charge, the method comprising the steps of:

transmitting the at least one wireless command signal from the at least one blasting machine, the at least one wireless command signal comprising a low frequency radio waves;

receiving the at least one wireless command signal by the at least one blasting component; and processing and optionally acting upon the at least one wireless command signal, as required.

Preferably, each of the at least one blasting component comprises a clock and a memory for storing a programmed delay time for actuation of the explosive charge, the at least one blasting machine or another component of the blasting apparatus transmitting:

a calibration signal having a carrier frequency of from 20-2500 Hz;

the step of receiving further comprising delineation of the oscillations of the calibration signal, or portions of the oscillations, thereby to allow synchronization of all clocks in the blasting components relative to one another, and establishment of a time zero, such that upon receipt by the at least one blasting component of a command signal to FIRE, the delay times counting down from a synchronized time zero thereby to effect timed actuation of each explosive charge associated with each blasting component, thereby to achieve a desired blasting pattern.

Alternatively, each of the at least one blasting component comprises a clock and a memory for storing a programmed delay time for actuation of the explosive charge, the method further comprising the steps of:

transmitting from a master clock, a clock synchronization signal to each of the at least one blasting component, thereby to synchronize all clocks of the at least one blasting component to the master clock; and establishing at least one synchronized time zero relative to the clock synchronization signal, for all clocks of the at least one blasting component;

such that upon receipt by the at least one blasting component of a command signal to FIRE, each of the at least one blasting component waiting for a next synchronized time zero and then counting down its programmed delay time resulting in actuation of an associated explosive charge, thereby to effect timed actuation of each explosive charge associated with each blasting component, thereby to achieve a desired blasting pattern.

In another aspect the present invention provides a method for blasting rock using a blasting apparatus comprising at least one blasting machine located on or above a surface of the ground for transmitting at least one wireless command signal, and at least one blasting component located below a surface of the ground for receiving and acting upon the at least one wireless command signal, each blasting component including or in operative association with an explosive charge and comprising a clock and a memory for storing a programmed delay time, the method comprising the steps of:

transmitting through rock from each blasting machine or another component of the blasting apparatus a calibration signal having a LF radio wave carrier frequency of from 20-2500 Hz;

receiving though rock the calibration signal by each blasting component;

processing the received calibration signal by:

optionally filtering the calibration signal;

determining from the calibration signal reference times such as zero-crossing times; and optionally calculating further reference times between the reference times thereby to establish a synchronized clock count for each blasting component;

transmitting through rock at least one command signal having a LF radio ware frequency of from 20-2500 Hz other than the frequency of the calibration signal;

receiving through rock the at least one command signal by each blasting component; and processing the received at least one command signal and acting upon the at least one command signal as required;

whereby, if the at least one command signal includes a signal to FIRE, each clock of each blasting component establishing a synchronized time zero and counting down from the synchronized time zero its own programmed delay time, thereby to effect timed actuation of each explosive charge associated with each blasting component, thereby to achieve a desired blasting pattern.

It should be noted that the methods of the present invention may be employed to control any type of blasting component, or device forming part of a blasting apparatus, adapted to receive wireless calibration and/or command signals from a remote source such as a blasting machine. The methods may be adapted, at least in selected embodiments, for use in mining operations involving below-ground placement of blasting components. However, the methods may be equally useful for above-ground mining operations for example involving the use of wireless detonator assemblies such as those taught in WO2006/047823 published May 11, 2006, which is incorporated herein by reference. In the case of underground mining operations, the methods of the present invention may involve the use of wireless electronic boosters, or wireless booster assemblies, such as those disclosed for example in co-pending U.S. patent application 60/795,569 filed Apr. 28, 2006 entitled "Wireless electronic booster, and methods of blasting", which is also incorporated herein by reference.

The invention further encompasses, in a further aspect, a blasting apparatus comprising:

at least one blasting machine for transmitting the at least one command signal;

a calibration signal generating means for generating a carrier signal having a frequency of from 20-2500 Hz;

at least one blasting component for receiving the at least one command signal and the calibration signal, each blasting component comprising: a detonator comprising a firing circuit and a base charge, an explosive charge being in operative association with the detonator, such that actuation of the base charge via the firing circuit causes actuation of the explosive charge; a transceiver for receiving and/or processing the at least one wireless command signal from the blasting machine and the calibration signal from the calibration signal generating means, the transceiver in signal communication with the firing circuit such that upon receipt of a command signal to FIRE the firing circuit causes actuation of the base charge and actuation of the explosive charge; a clock; a memory for storing a programmed delay time; and delineation means to delineate the oscillations of the calibration signal, or portions of the oscillations, thereby to allow synchronization of all clocks in the blasting components relative to one another, and establishment of a time zero, such that upon receipt by the at least one blasting component of a command signal to FIRE, the delay times counting down from a synchronized time zero thereby to effect timed actuation of each explosive charge associated with each blasting component, thereby to achieve a desired blasting pattern. In another aspect, the invention provides for a blasting component as described in connection with the aforementioned blasting apparatus.

In another aspect the invention provides for a blasting apparatus comprising:

at least one blasting machine for transmitting the at least one command signal;

a master clock for generating a clock synchronization signal and transmitting the clock synchronization signal to each of the at least one blasting component, thereby to synchronize all clocks of the at least one blasting component to the master clock; and at least one blasting component for receiving the at least one command signal and the clock synchronization signal, each blasting component comprising: a detonator comprising a firing circuit and a base charge, an explosive charge being in operative association with the detonator, such that actuation of the base charge via the firing circuit causes actuation of the explosive charge; a transceiver for receiving and/or processing the at least one wireless command signal from the blasting machine and the clock synchronization signal from the master clock, the transceiver in signal communication with the firing circuit such that upon receipt of a command signal to FIRE the firing circuit causes actuation of the base charge and actuation of the explosive charge; a clock; a memory for storing a programmed delay time; and clock calibration means to delineate the clock synchronization signal, thereby to synchronize the clock to the master clock, and establish at least one synchronized time zero, such that upon receipt by the at least one blasting component of a command signal to FIRE, each of the at least one blasting component waiting for a next synchronized time zero and then counting down its programmed delay time the expiry of which resulting in actuation of an associated explosive charge, thereby to effect timed actuation of each explosive charge associated with each blasting component, thereby to achieve a desired blasting pattern. Preferably, the master clock further transmits at least one further clock synchronization signal to the at least one blasting component, the clock calibration means re-synchronizing each clock of the at least one blasting component to the master clock if required, in accordance with the at least one further clock synchronization signal, thereby to correct drift between each clock relative to the master clock.

In another aspect, the invention, provides for a blasting component as described in connection with the aforementioned blasting apparatus.

DEFINITIONS

Figure 1:
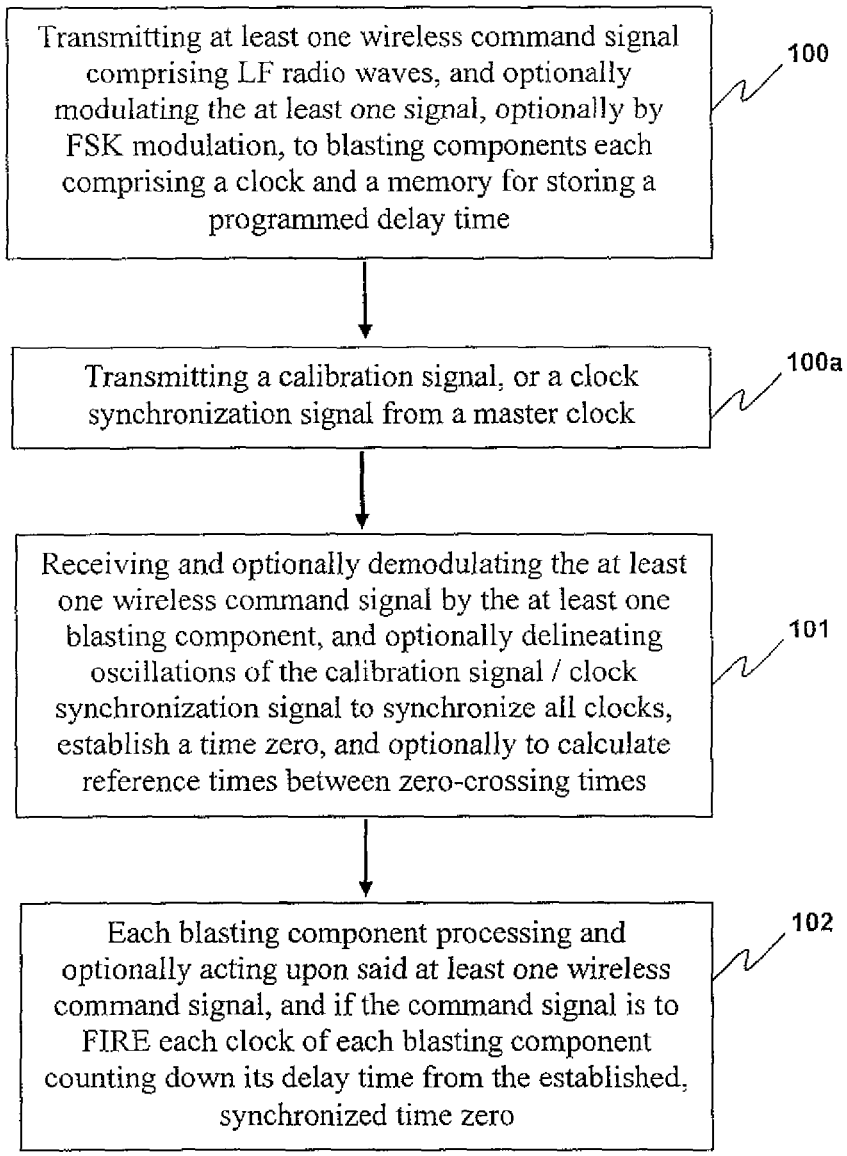
FIG. 1 schematically illustrates a preferred method of the present invention.

Activation signal: any signal transmitted by any component of a blasting apparatus that causes blasting components to become active components of the blasting apparatus. Typically, in selected embodiments the blasting components may be in an inactive state, but "listen-up" periodically to check whether they can receive an activation signal. In the absence of receipt of such an activation signal the blasting components may fall back into an inactive state. However, upon successful receipt of an activation signal, for example transmitted to all blasting components at a blast site by for example a blasting machine, the blasting components may effectively be caused to "wake-up" fully, and hence become a fully active and fully functioning component of the blasting apparatus.

Active power source: refers to any power source that can provide a continuous or constant supply of electrical energy. This definition encompasses devices that direct current such as a battery or a device that provides a direct or alternating current. Typically, an active power source provides power to a command signal receiving and/or processing means, to permit reliable reception and interpretation of command signals derived from a blasting machine.

Automated/automatic blasting event: encompasses all methods and blasting systems that are amenable to establishment via remote means for example employing robotic systems at the blast site. In this way, blast operators may set up a blasting system, including an array of detonators and explosive charges, at the blast site from a remote location, and control the robotic systems to set-up the blasting system without need to be in the vicinity of the blast site.

Base charge: refers to any discrete portion of explosive material in the proximity of other components of the detonator and associated with those components in a manner that allows the explosive material to actuate upon receipt of appropriate signals from the other components. The base charge may be retained within the main casing of a detonator, or alternatively may be located nearby the main casing of a detonator. The base charge may be used to deliver output power to an external explosives charge to initiate the external explosives charge.

Blasting component: refers to any device that can receive one or more command signals from an associated blasting machine, process those signals, and if required (for example upon receipt of a command signal to FIRE) cause actuation of an explosive material or charge associated forming an integral part of, or associated in some way, with the blasting component. Typically, a blasting component will include means to receive the command signal, and means to process the command signal, as well as a detonator including a firing circuit and a base charge in operable association with the receiving and processing means. The blasting component may comprising any type of detonator known in the art including but not limited to a non-electric detonator, an electric detonator, and a pyrotechnic delay detonator, and a programmable electronic detonator. Typically, a blasting component will encompass, for example, a wireless detonator assembly, a wireless electronic booster etc. A blasting component, and any component thereof, may include a memory means for storing a delay time, and/or a clock for counting down a delay time stored for example in an associated memory means. For example, a transceiver and the detonator are examples of components that may comprise a memory means and/or a clock.

Blasting machine: any device that is capable of being in signal communication with electronic detonators, for example to send ARM, DISARM, and FIRE signals to the detonators, and/or to program the detonators with delay times and/or firing codes. The blasting machine may also be capable of receiving information such as delay times or firing codes from the detonators directly, or this may be achieved via an intermediate device to collect detonator information and transfer the information to the blasting machine.

Booster: refers to any device of the present invention that can receive wireless command signals from an associated blasting machine, and in response to appropriate signals such as a wireless signal to FIRE, can cause actuation of an explosive charge that forms an integral component of the booster. In this way, the actuation of the explosive charge may induce actuation of an external quantity of explosive material, such as material charged down a borehole in rock. In selected embodiments, a booster may comprise the following non-limiting list of components:

- a detonator comprising a firing circuit and a base charge;
- an explosive charge in operative association with the detonator, such that actuation of the base charge via the firing circuit causes actuation of the explosive charge; and
- a transceiver for receiving and processing the at least one wireless command signal from the blasting machine, the transceiver in signal communication with the firing circuit such that upon receipt of a command signal to FIRE the firing circuit causes actuation of the base charge and actuation of the explosive charge. In preferred embodiments, the booster will be a wireless electronic booster such that the transceiver can receive wireless calibration and/or command signals from a remote source. Most preferably, the transceiver can receive and delineate low frequency radio waves transmitted through rock.

Calibration signal: refers to a wireless signal received by a blasting component with the intention that the calibration signal can be used by the blasting component to establish a clock count for an internal clock in the blasting, component. Preferably, the calibration signal is such that the clock counts for the blasting components are synchronized in a manner that upon receipt by the blasting components of a command signal to FIRE, the blasting components establish a synchronized time zero from which delay times are counted down, and upon expiry of the delay times explosive charges forming an integral part of or associated with a blasting component are actuated.

Central command station: refers to any device that transmits signals via radio-transmission or by direct connection, to one or more blasting machines. The transmitted signals may be encoded, or encrypted. Typically, the central blasting station permits radio communication with multiple blasting machines from a location remote from the blast site.

Charge/charging: refers to a process of supplying electrical power from a power supply to a charge storage device, with the aim of increasing an amount of electrical charge stored by the charge storage device. As desired in preferred embodiments, the charge in the charge storage device surpasses a threshold sufficiently high such that discharging of the charge storage device via a firing circuit causes actuation of a base charge associated with the firing circuit.

Charge storage device: refers to any device capable of storing electric charge. Such a device may include, for example, a capacitor, diode, rechargeable battery or activatable battery. At least in preferred embodiments, the potential difference of electrical energy used to charge the charge storage device is less or significantly less than the potential difference of the electrical energy upon discharge of the charge storage device into a firing circuit. In this way, the charge storage device may act as a voltage multiplier, wherein the device enables the generation of a voltage that exceeds a predetermined threshold voltage to cause actuation of a base charge connected to the firing circuit.

Clock: encompasses any clock suitable for use in connection with any component of a blasting system of the invention, for example to time delay times for detonator actuation during a blasting event. Therefore a clock may also form part of a blasting machine, blasting component, or any other part of a blasting apparatus, or may constitute an independent module. The clock may be independent from or form an integral part of any component of a blasting component. In particularly preferred embodiments, the term clock relates to a crystal clock, for example comprising an oscillating quartz crystal of the type that is well know, for example in conventional quartz watches and timing devices. Crystal clocks may provide particularly accurate timing in accordance with preferred aspects of the invention. Under specific conditions, however, some clocks such as crystal clocks may be fragile and prone to breakage during use especially if the clock is exposed to blasting forces. Therefore, in preferred embodiments a clock may be protected in a protective shell or casing. Alternatively, a different type of clock may be used that is more robust, and many such clocks are known in the art. For example, simple robust clocks may include for example a simple RC circuit of a type that is known in the art, comprising a resistor and a capacitor. In other embodiments, a clock may form an integral feature of an integrated circuit such as a programmable integrated circuit (PIC) or an application specific integrated circuit (ASIC). Furthermore, such an integrated circuit may for part of, or form, a state machine for any part of a blasting apparatus as described herein, such as a blasting component. In this way, the clock either independently or in combination with processed incoming signals, may cause the blasting component to adopt specific pre-determined states for normal functioning of the blasting apparatus. A 'master clock' refers to any clock as described herein, that furthermore has been designated as the clock to which all other clocks are synchronized either once or more than once during operation of the methods and apparatuses of the invention. For example, a master clock may communicate with another clock either by direct electrical contact (e.g. prior to placement of a blasting component comprising another clock at the blast site), via short-range wireless communication with the other clock (e.g. prior to placement of as blasting component comprising another clock at the blast site), via longer range wireless communication (e.g. after placement of a blasting component comprising another clock at the blast site) or preferably via LF radio waves (e.g. after placement of a blasting component comprising a clock underground at the blast site).

Clock synchronization signal/further clock synchronization signal: refers to any signal transmitted by a master clock to one or more other components of a blasting apparatus that itself includes a clock, such that receipt and processing of the signal by the other component causes synchronization of its internal clock with the master clock. Typically, but not necessarily, a clock synchronization signal may be a first such signal transmitted by a master clock to achieve initial calibration and/or synchronization of a clock with the master clock. In contrast, a "further" clock synchronization signal refers to any clock synchronization signal subsequent to the initial clock synchronization signal for use e.g. in re-synchronization of clocks to the master clock to correct 'drift'. A further clock synchronization signal (or a time taken relative to a further clock synchronization signal) may also be designated by a blasting component as a "time zero" to begin counting down a pre-programmed delay time, providing a command signal to FIRE is received by the blasting component beforehand, for example since the preceding clock synchronization signal was received. Clock synchronization signals may alternatively, in selected embodiments, function to "wake-up" an inactive blasting component (or a blasting component in a "listening state") to bring the blasting component into a fully active state in the blasting apparatus. A clock synchronization signal may be, at least in selected embodiments, synonymous with a calibration signal.

Delineation means: refers to any component that is able to delineate or otherwise decipher the presence of oscillations (or portions thereof) of a calibration signal from all other information, signals, or noise received by a transceiver or receiver. For example, transmission of a calibration signal at a blast site may be carried out via wired or wireless signal transmission over ground, through or around surface objects, or through layers of the ground such as rock. Such signals may be prone to interference, noise, unwanted signal reflections/refractions etc. all of which may contribute to extraneous signals and noise over and above the calibration signal being broadcast. A delineation means aims to aid in the receipt, extraction, and processing of a calibration signal through modification of the received signals and noise. For example, a delineation means may optionally include one or more filters to filter wavelengths or frequencies of received energy other than those expected for the calibration signal, and optionally may include one or more amplifiers to amplify selected portions (e.g. selected frequencies or wavelengths) of received energy. In this way, the calibration signal may be better differentiated from received background noise, extraneous noise, and other signals. Other features and/or components of a delineation means will be apparent to the skilled artisan, and delineation means may include any of such other features and/or components as required to achieve the desired result of delineation of the calibration signal.

Electromagnetic energy: encompasses energy of all wavelengths found in the electromagnetic spectra. This includes wavelengths of the electromagnetic spectrum division of γ-rays, X-rays, ultraviolet, visible, infrared, microwave, and radio waves including UHF, VHF, Short wave, Medium Wave, Long Wave, VLF and ULF. Preferred embodiments use wavelengths found in radio, visible or microwave division of the electromagnetic spectrum.

Explosive charge: includes an discreet portion of an explosive substance contained or substantially contained within a booster. The explosive charge is typically of a form and sufficient size to receive energy derived from the actuation of a base charge of a detonator, thereby to cause ignition of the explosive charge. Where the explosive charge is located adjacent or near to a further quantity of explosive material, such as for example explosive material charged into a borehole in rock, then the ignition of the explosive charge may, under certain circumstances, be sufficient to cause ignition of the entire quantity of explosive material, thereby to cause blasting of the rock. The chemical constitution of the explosive charge may take any form that is known in the art, most preferably the explosive charge may comprise TNT or pentolite.

Explosive material: refers to any quantity and type of explosive material that is located outside of a booster, but which is in operable association with the booster, such that ignition of the explosive charge within the booster causes subsequent ignition of the explosive material. For example, the explosive material may be located or positioned down a borehole in the rock, and a booster may be located in operative association with the explosive material down or near to the borehole. In preferred embodiments the explosive material may comprise pentolite or TNT.

Filtering: refers to any known filtering technique for filtering received signal information from noise such as background noise or interference. Is selected examples filtering may employ a device for excluding signals having a frequency outside a predetermined range. In preferred embodiments the filter may be, for example, a band pass filter. However, other filters and filtering techniques may be used in accordance with any methods or apparatuses of the invention. The filter may be passive, active, analog, digital, discrete-time (sampled), continuous-time, linear, non-linear or of any other type known in the art.

Forms of energy: In accordance with the present invention, "forms" of energy may take any form appropriate for wireless communication and/or wireless charging of the detonators. For example, such forms of energy may include, but are not limited to, electromagnetic energy including light, infrared, radio waves (including ULF), and microwaves, or alternatively make take some other form such as electromagnetic induction or acoustic energy. In addition, "forms" of energy may pertain to the same type of energy (e.g. light, infrared, radio waves, microwaves etc.) but involve different wavelengths or frequencies of the energy.

"Keep alive" signal: refers to any signal originating from a blasting machine and transmitted to a blasting component, either directly or indirectly (e.g. via other components or relayed via other wireless detonator assemblies), that causes a charge storage device to be charged by a power source and/or to retain charge already stored therein; In this way, the charge storage device retains sufficient charge so that upon receipt of a signal to FIRE, the charge is discharged into the firing circuit to cause a base charge associated with the firing circuit to be actuated. The "keep alive" signal may comprise any form of suitable energy identified herein. Moreover, the "keep alive" signal may be a constant signal, such that the wireless detonator assembly is primed to FIRE at any time over the duration of the signal in response to an appropriate FIRE signal. Alternatively, the "keep alive" signal may comprise a single signal to prime the wireless detonator assembly to FIRE at any time during a predetermined time period in response to a signal to FIRE. In this way, the blasting component may retain a suitable status for firing upon receipt of a series of temporally spaced "keep alive" signals.

Logger/Logging device: includes any device suitable for recording information with regard to a blasting component, or a detonator contained therein. For example, the logger may transmit or receive information to or from a blasting component of the invention or components thereof. For example, the logger may transmit data to a blasting component such as, but not limited to, blasting component identification codes, delay times, synchronization signals, firing codes, positional data etc. Moreover, the logger may receive information from a blasting component including but not limited to, blasting component identification codes, firing codes, delay times, information regarding the environment or status of the blasting component, information regarding the capacity of the blasting component to communicate with an associated blasting machine (e.g. through rock communications). Preferably, the logging device may also record additional information such as, for example, identification codes for each detonator, information regarding the environment of the detonator, the nature of the explosive charge in connection with the detonator etc. In selected embodiments, a logging device may form an integral part of a blasting machine, or alternatively may pertain to a distinct device such as for example, a portable programmable unit comprising memory means for storing data relating to each detonator, and preferably means to transfer this data to a central command station or one or more blasting machines. One principal function of the logging device, is to read the blasting component so that the blasting component or detonator contained therein can be "found" by an associated blasting machine, and have commands such as FIRE commands directed to it as appropriate. A logger may communicate with a blasting component either by direct electrical connection (interface) or a wireless connection of any type known in the art, such as for example short range RF, infrared, Bluetooth etc.

Micro-nuclear power source: refers to any power source suitable for powering the operating circuitry, communications circuitry, or firing circuitry of a detonator or wireless detonator assembly according to the present invention. The nature of the nuclear material in the device is variable and may include, for example, a tritium based battery.

Passive power source: includes any electrical source of power that does not provide power on a continuous basis, but rather provides power when induced to do so via external stimulus. Such power sources include, but are not limited to, a diode, a capacitor, a rechargeable battery, or an activatable battery. Preferably, a passive power source is a power source that may be charged and discharged with ease according to received energy and other signals. Most preferably the passive power source is a capacitor.

Power supply (without recitation of the power source being an 'active power source' or a 'passive power source'): refers to a power supply that is capable of supplying a fairly constant supply of electrical power, or at least can provide electrical power as and when required by connected components. For example, such power supplies may include but are not limited to a battery.

Preferably: identifies preferred features of the invention. Unless otherwise specified, the term preferably refers to preferred features of the broadest embodiments of the invention, as defined for example by the independent claims, and other inventions disclosed herein.

Reference times/Further reference times: refers to points in the oscillation of a received signal, such as a low frequency radio signal, more readily calculated by a blasting component of a blasting apparatus of the present invention. For example, such a blasting component may receive an incoming wireless calibration signal (e.g. through rock) from a blasting machine, optionally amplify and/or filter the signal, and determine zero-crossings for the signal, which form the reference times for time calibration. In selected embodiments, further reference times may be calculated from the reference times by determining time points between the reference times, thereby to increase the temporal resolution of the calibration signal.

Time zero: refers to any time from which a delay time pre-programmed into a blasting component begins counting down, such that completion of the count down results in actuation of a base charge of an integrated detonator, and optionally actuation of an associated explosive charge. In accordance with the methods and apparatuses of the invention, a time zero may be established in a synchronous or substantially synchronous manner between blasting components so that pre-programmed delay times can be counted down from a synchronized or substantially synchronized start time (time zero), thereby permitting timed actuation of a blasting event. Typically, but not necessarily, a time zero may coincide with receipt of a further clock synchronization signal, or another time relative to a clock synchronization signal.

Top-box: refers to any device forming part of a blasting component that is adapted for location at or near the surface of the ground when the blasting component is in use at a blast site in association with a bore-hole and explosive charge located therein. Top-boxes are typically located above-ground or at least in a position in, at or near the borehole that is more suited to receipt and transmission of wireless signals, and for relaying these signals to the detonator down the bore-hole. In preferred embodiments, each top-box comprises one or more selected components of the blasting component of the present invention.

Transceiver: refers to any device that can receive and/or transmit wireless signals. Although the term "transceiver" traditionally encompasses a device that can both transmit and receive signals, a transceiver when used in accordance with the present invention includes a device that can function solely as a receiver of wireless signals, and not transmit wireless signals or which transmits only limited wireless signals. For example, under specific circumstances the transceiver may be located in a position where it is able to receive signals from a source, but not able to transmit signals back to the source or elsewhere. In very specific embodiments, where the transceiver forms part of a booster located underground, the transceiver may be able to receive signals through-rock from a wireless source located above a surface of the ground, but be unable to transmit signal back through the rock to the surface. In these circumstances the transceiver optionally may have the signal transmission function disabled or absent. In other embodiments, the transceiver may transmit signals only to a logger via direct electrical connection, or alternatively via short-range wireless signals. In other embodiments, a transceiver may comprise a memory for storing a delay time, and may be programmable with a delay time (this is especially useful when the detonator and components thereof are not programmable, as may be the case for example with a non-electric electric, or selected pyrotechnic detonator.

Wireless: refers to there being no physical wires (such as electrical wires, shock tubes, LEDC, or optical cables) connecting the detonator or a blasting component, or components thereof to an associated blasting machine or power source.

Wireless booster: In general the expression "wireless booster" or "electronic booster" encompasses a device comprising a detonator, most preferably an electronic detonator (typically comprising at least a detonator shell and a base charge) as well as means to cause actuation of the base charge upon receipt by the booster of a signal to FIRE from at least one associated blasting machine. For example, such means to cause actuation may include a transceiver or signal receiving means, signal processing means, and a firing circuit to be activated in the event of a receipt of a FIRE signal. Preferred components of the wireless booster may further include means to transmit information regarding the assembly to other assemblies or to a blasting machine, or means to relay wireless signals to other components of the blasting apparatus. Such means to transmit or relay may form part of the function of the transceiver. Other preferred components of a wireless booster will become apparent from the specification as a whole.

Zero crossing(s): refers to an instantaneous point at which, for a sine wave, the y-value=zero. In a sine wave or other simple waveform, this normally occurs twice during each cycle. In the case of the present invention, such a sine wave may be derived from a calibration signal in the form of a low frequency radio wave, wherein the zero-crossings occur at the beginning and half-way points of each oscillation in the cycle. However, zero-crossings are not limited to sine-waves. It should be noted that zero-crossings may also be determined under circumstances, for example, where frequency-shift key modulation generates a binary signal transmission, where zero-crossing analysis may facilitate determination of frequency shifts in the received signal.

DETAILED DESCRIPTION OF THE PREFERRED EMBODIMENTS

The inventors have succeeded in the development of methods for controlling, and optionally calibrating or synchronizing, components of a blasting apparatus that communicate with a blasting machine via wireless communication signals. In selected embodiments, the methods are especially useful for underground mining operations, where wireless electronic boosters positioned underground communicate with one or more blasting machines positioned at or above a surface of the ground. Such wireless electronic boosters are described, for example, in the present application as well as for example in co-pending U.S. provisional application 60/795,569 filed Apr. 28, 2006 entitled "Wireless electronic booster, and methods of blasting", which is incorporated herein by reference.

Wireless blasting systems help circumvent the need for complex wiring between components of a blasting apparatus at the blast site, and the associated risks of improper placement, association and connection of the components of the blasting system.

Through careful investigation, and significant inventive ingenuity, the inventors have developed methods for communicating with and controlling blasting components such as wireless detonator assemblies, or wireless booster assemblies, via wireless communication signals. Such wireless communication signals may include, but are not limited to, command signals derived for example from a blasting machine, as well as calibration signals derived for example from a blasting machine or another component of a blasting apparatus. Most preferably, the methods allow for the control of, and actuation of explosive charges associated with, wireless electronic boosters and wireless booster assemblies located below ground. In this way, wireless through-rock transmission of signals may be achieved. Such as wireless electronic booster is described, for example, if co-pending U.S. Patent application 60/795,569 filed Apr. 28, 2006 entitled "Wireless electronic booster, and methods of blasting". For example, such a device may include:

a detonator comprising a firing circuit and a base charge;

an explosive charge in operative association with the detonator, such that actuation of the base charge via the firing circuit causes actuation of the explosive charge;

a transceiver for receiving and processing the at least one wireless command signal from the blasting machine, the transceiver in signal communication with the firing circuit such that upon receipt of a command signal to FIRE the firing circuit causes actuation of the base charge and actuation of the explosive charge.

The present invention encompasses, at least in part, methods of communication between at least one blasting machine of a blasting apparatus, and at least one other component of a blasting apparatus which comprises, or is in operative association with, an explosive charge or quantity of explosive material. Such blasting components may include, but are not limited to, wireless detonator assemblies or wireless booster assemblies. Such wireless detonator assemblies are described, for example, in WO2006/096920 published Sep. 21, 2006, which is incorporated herein by reference. Such wireless booster assemblies are described for example in U.S. patent application 60/795,569 filed Apr. 28, 2006 entitled "Wireless electronic booster, and methods of blasting", which is also incorporated herein by reference. The methods may involve transmitting from the at least one blasting machine at least one command signal. For example, such command signals may be selected from, but are not limited to, signals to ARM, DISARM, FIRE, ACTIVATE, or DEACTIVATE the blasting component. In preferred embodiments, the wireless signals are transmitted using low frequency radio waves, such as those having a frequency in the range of 20-2500 Hz. In this way, the signals may optionally be transmitted though the ground, through rock or other media and successfully be received and delineated by a blasting component.

In preferred embodiments, the wireless signals may be modulated via any known technique prior to their transmission, and upon receipt by a blasting component may be demodulated. As is known in the art, such signal processing may help the blasting component to delineate each signal from background noise, or interference caused for example by through rock or through water signal transmission. In other aspects, filters may also be used to reduce a level of noise from received signals. For example, such filters where present may extract only those signals having a frequency that falls within a pre-determined range. Increased levels of radio-noise may also be experienced for frequencies of around 50 Hz and harmonics thereof, due in part to the local use of electrical equipment operating with a 50 Hz A/C current. Optionally, operating frequencies and filters may be employed to avoid such noise-prone frequency ranges.

In other aspects, the wireless command signals may be transmitted using frequency shift key (FSK) modulation techniques that are well known in the art. FSK is a well known technique for modulating data that uses two frequencies. Frequency shifts between the two frequencies are generated, when the binary digital level changes. One particular frequency is used to represent a binary one, and a second frequency is used to indicate a binary zero. Such modulation techniques are especially useful in accordance with the present invention for through-rock wireless signal transmission. For example, more complex wireless command signals such as delay times may be amenable to through rock transmission using FSK modulation. The binary nature of the received FSK modulated signal may be easier to extract and interpret from signal data received through-rock in comparison to a non-FSK modulated analogue signal.

In preferred embodiments of the methods of the invention, the radio signals comprise 20-2500 Hz, more preferably 100-2000 Hz, more preferably 200-1200 Hz most preferably about 300 Hz. The radio-wave frequency will be selected on the basis of rock penetration and noise considerations. Broadly speaking, lower frequencies will give rise to greater rock penetration. However, very low frequency signals will be limited in terms of complexity, and require very large and expensive transmitters to produce the corresponding radio waves.

In other embodiments of the methods of the invention, each of the blasting components of the blasting apparatus may include a clock, preferably a crystal clock, and a memory for storing a delay time. The clock and memory may optionally form an integral part of an electronic detonator forming part of the blasting component, or may be located elsewhere in the blasting component. The methods of the invention, in selected embodiments, further provide a mechanism for clock calibration and synchronization, even under circumstances where the blasting components are located underground. The blasting machine or any other component of the blasting apparatus located on or near a surface of the ground may transmit to the blasting components a calibration signal preferably comprising LF radio waves in the range of 20-2500 Hz. Following receipt of the calibration signal, each blasting component may analyze the received signal to delineate from the signal reference times for the signal oscillation. Preferably, such reference times may include zero-crossings for the signal, with two zero-crossings for each period (one at the beginning, and one half-way through, an oscillation). In effect, these reference points may serve to provide a "ticking clock" allowing for calibration of each clock or crystal clock of each blasting component.

Often, the blasting components may comprise electronic delay detonators capable of being programmed with delay times of 1 ms or less. However, at very low frequencies, zero-crossing reference points may not provide sufficient temporal resolution to allow for delay time programming and synchronization down to 1 ms or less. For example, if the calibration signal has a frequency of 30 Hz, there will be only 60 zero-crossings per second, providing a resolution of 1 zero-crossing every 16.67 ms. In other words, the use of a calibration signal having a 30 Hz carrier frequency may provide excellent rock penetration, but on the basis of zero-crossing may provide insufficient temporal resolution for the purposes of clock calibration and delay times. In accordance with preferred aspects of the present invention there are provided further methods for increasing the temporal resolution of the calibration signal. This may be achieved by calculating further reference times between the zero-crossing reference times. In the case of a radio frequency of 30 Hz, each average time spacing between zero-crossing may be equally divided, for example, into 20 equal portions to provide a temporal resolution in the order of 16.67 ms/20=0.838 ms—i.e. less than one millisecond. Therefore, the present invention encompasses methods that allow for analysis of a calibration signal by analyzing not only easily attainable reference points (such as zero-crossings), but also further reference points therebetween. In this way, the methods allow for clock calibration and synchronization down to a temporal resolution that at least matches or exceeds the accuracy of electronic detonators known in the art.

In further embodiments of the methods of the invention, there are provided methods of blasting rock using a blasting apparatus comprising at least one blasting machine located on or above a surface of the ground for transmitting at least one wireless command signal and at least one blasting component located below a surface of the ground for receiving and optionally acting upon the at least one wireless command signal. Each blasting component may comprise a clock as well as a memory for storing a programmed delay time, and be in operable association with an explosive charge or quantity of explosive material. The steps of the preferred method may include:

transmitting through rock from each blasting machine or another component of the blasting apparatus a calibration signal having a LF radio wave carrier frequency of from 20-2500 Hz;

receiving though rock the calibration signal by each blasting component;

processing the received calibration signal by:

optionally filtering the calibration signal;

determining from the calibration signal reference times such as zero-crossing times; and optionally calculating further reference times between the reference times thereby to establish a synchronized clock count for each blasting component;

transmitting through rock at least one command signal having a LF radio wave frequency of from 20-2500 Hz other than the frequency of the calibration signal;

receiving through rock the at least one command signal by each blasting component; and processing the received at least one command signal and acting upon the at least one command signal as required.

If the at least one command signal includes a signal to FIRE, each clock of each blasting component establishes a synchronized time zero and counts down from the synchronized time zero its own programmed delay time, thereby to effect timed actuation of each explosive charge associated with each blasting component, thereby to achieve a desired blasting pattern. In spite of their placement below ground, the blasting components may be optionally programmed with delay times, and the clock may be calibrated and/or synchronized to count down those delay times in response to a command signal to FIRE, all through remote communication with a blasting machine or other devices located above ground.

The invention encompasses methods in which the blasting components are simply placed as required in underground locations at the blast site, and are subsequently programmed with delay times, firing codes, identification information, and controlled by wireless command signals from above ground after placement.

The invention also encompasses alternative methods in which the blasting components are placed as required at underground locations at the blast site, programmed in situ with, for example, delay times, firing codes, or identification information through direct electrical or short-range wireless communication with a logger or logging device. Subsequently, the blasting components receive only wireless command signals from an associated blasting machine above ground. This may be especially useful where, for example, there is significant interference to prevent clear through-rock transmission of more complex signals, such as those to program delay times, firing codes, identification information etc. to the blasting components.

It should be noted that the methods of the present invention may be employed to control any type of blasting component, or device forming part of a blasting apparatus, adapted to receive wireless calibration and/or command signals from a remote source such as a blasting machine. The methods may be adapted, at least in selected embodiments, for use in mining operations involving below-ground placement of blasting components. However, the methods may be equally useful for above-ground mining operations for example involving the use of wireless detonator assemblies such as those taught in WO2006/047823 published May 11, 2006, which is incorporated herein by reference. In the case of underground mining operations, the methods of the present invention may involve the use of wireless electronic boosters, or wireless booster assemblies, such as those disclosed for example in co-pending U.S. patent application 60/795,569 filed Apr. 28, 2006 entitled "Wireless electronic booster, and methods of blasting", which is also incorporated herein by reference.

The invention will further be described with reference to specific examples, which are in no way intended to be limiting with respect to the appended claims:

EXAMPLE 1

Method for Communication Between Components of a Blasting Apparatus

A preferred method of the invention will be described with reference to FIG. 1. In this method there is provided a method of communicating at least one wireless command signal from at least one blasting machine to at least one blasting component comprising or in operative association with an explosive charge. Step 100 involves the transmitting of at least one wireless command signal from the at least one blasting machine to the at least one blasting component using low frequency radio waves, and optionally modulating the at least one signal, optionally by frequency shift key (FSK) modulation, to blasting components each comprising a clock and a memory for storing a programmed delay time. In step 100*a* a calibration signal is transmitted, or a clock synchronization signal is transmitted from a master clock. In step 101 there is included the step of receiving the at least one wireless command signal by the at least one blasting component, and optionally delineating oscillations of the calibration signal/clock synchronization signal to synchronize all clocks, establish a time zero, and optionally to calculate reference times between zero-crossing times. In step 102 each blasting component processes the received at least one wireless command signal and optionally acts upon the instructions provided in the at least one wireless command signal as required.

EXAMPLE 2

Method Involving a Calibration Signal

Figure 2:
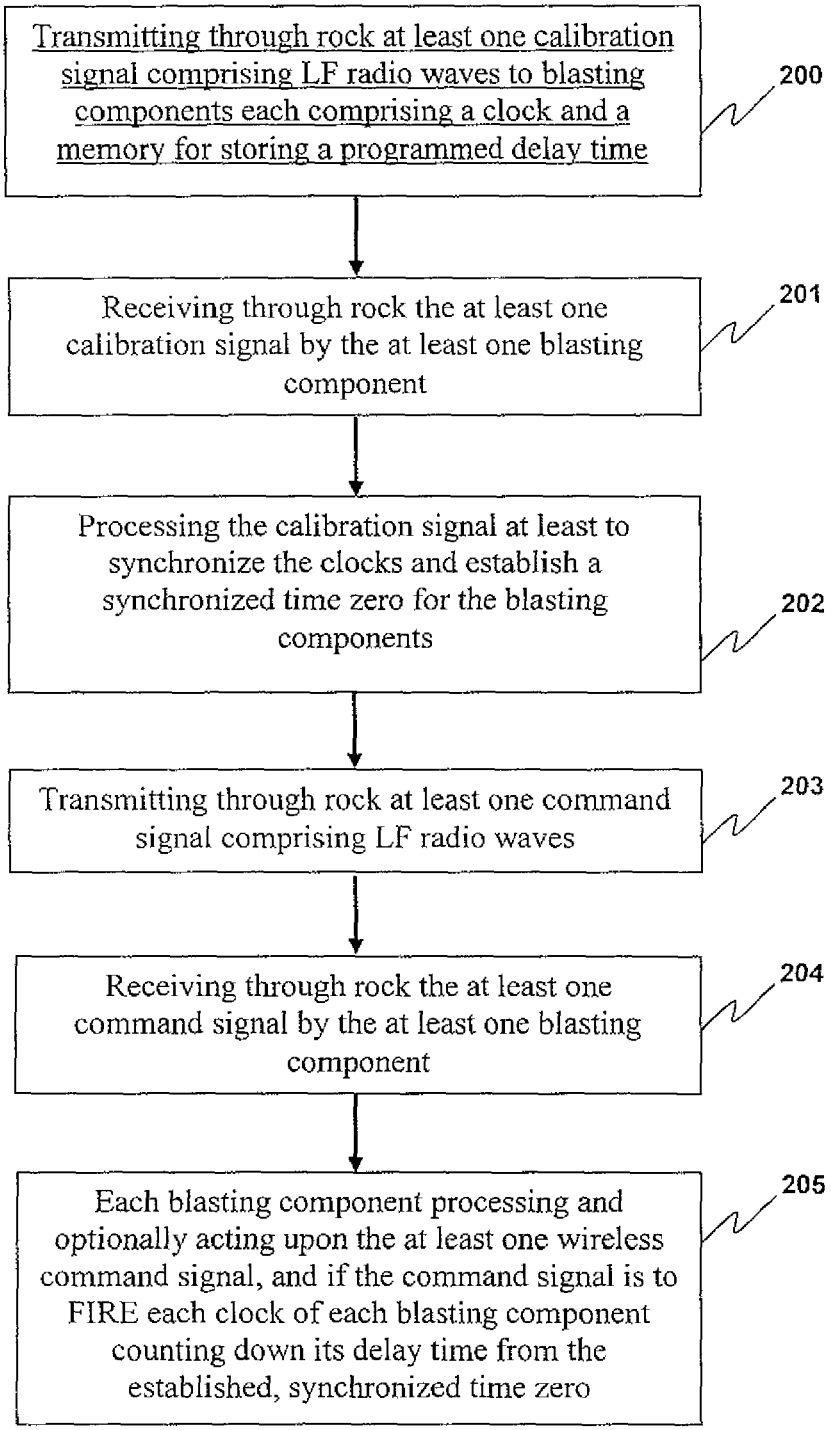
FIG. 2 schematically illustrates a preferred method of the present invention.

A preferred method of the invention will be described with reference to FIG. 2. In this method there is provided a method for blasting rock using a blasting apparatus comprising at least one blasting machine on or above a surface of the ground, for transmitting at least one wireless command signal, and at least one blasting component located below a surface of the ground for receiving and acting upon the at least one wireless command signal as required, each blasting component including or in operative association with an explosive charge and comprising a clock and a memory for storing a programmed delay time. Step 200 involves transmitting through rock from each blasting machine or another component of the blasting apparatus a calibration signal having a LF radio wave carrier frequency of from 20-2500 Hz to blasting components each comprising a clock and a memory for storing a programmed delay time. Step 201 involves receiving through rock the calibration signal by each blasting component. Step 202 involves processing the received calibration signal by: optionally filtering the calibration signal; determining from the calibration signal reference times such as zero-crossing times, and optionally calculating further reference times between the reference times thereby to establish a synchronized clock count for each blasting component. Step 203 involves transmitting through rock at least one command signal having a LF radio wave frequency of from 20-2500 Hz other than the frequency of the calibration signal. Step 204 involves receiving through rock the at least one command signal by each blasting component, and step 205 involves processing the received at least one command signal and acting upon the at least one command signal as required. In this way, if the at least one command signal includes a signal to FIRE, each clock of each blasting component establishes a synchronized time zero and counts down from the synchronized time zero its own programmed delay time, thereby to effect timed actuation of each explosive charge associated with each blasting component, thereby to achieve a desired blasting pattern.

EXAMPLE 3

Binary Coding of a Calibration Signal

As previously discussed, calibration signals for clock synchronization may be useful if time spacings between, for example, zero-crossings are appropriately calculated. Preferably, the frequency of the signal will remain relatively constant so that the amount of "jitter" in the signal oscillations is reduced, and the blasting component can detect a fairly regular time spacing between zero-crossings. By averaging the time spacings, any jitter in the signal may be compensated for.

Figure 3:
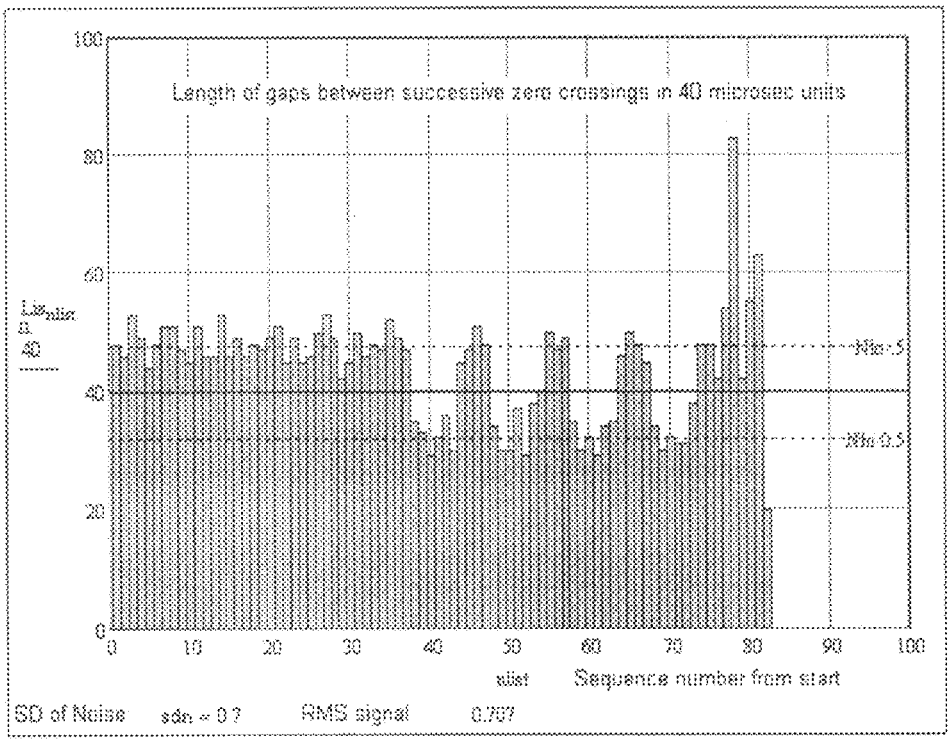
FIG. 3 provides a graph of times between successive zero-crossings received by a blasting component in a test blasting apparatus.

With reference to FIG. 3, there is shown a graph of times between successive zero-crossings received by a blasting component in a test blasting system. It will be noted that for the first 35 zero-crossings detected, a time spacing of an average 48 microseconds is detected. The Figure also shows some experimentation with FSK modulation to generate a binary code for signal transmission as part of the calibration signal. For counts 38 to 43, 48 to 53, 58 to 63, and 68 to 73 a smaller time interval exists between successive zero-spacing: in this case an average time spacing of 32 microseconds is recorded. In contrast, for counts 44 to 47, 54 to 57, 64 to 67, and 74 up there is an average time interval of 48 microseconds. In this way, binary information can be integrated into the calibration signal itself. For example, in FIG. 3 the counts 38 to 43 may represent a "0" in binary code, whereas the counts 44 to 47 may represent a "1" in binary code. Nonetheless the binary bits exist for the same amount of time (about 190 ms) due to the smaller time intervals for the "0" readings.

Although FIG. 3 is merely exemplary, a person skilled in the art will appreciate the possible integration of command signals into a calibration signal. By altering the frequency of the calibration signal by FSK modulation, binary information may be incorporated into the "ticking clock" of the calibration signal.

EXAMPLE 4

Radio-Frequency Variation with Distance

Figure 4:
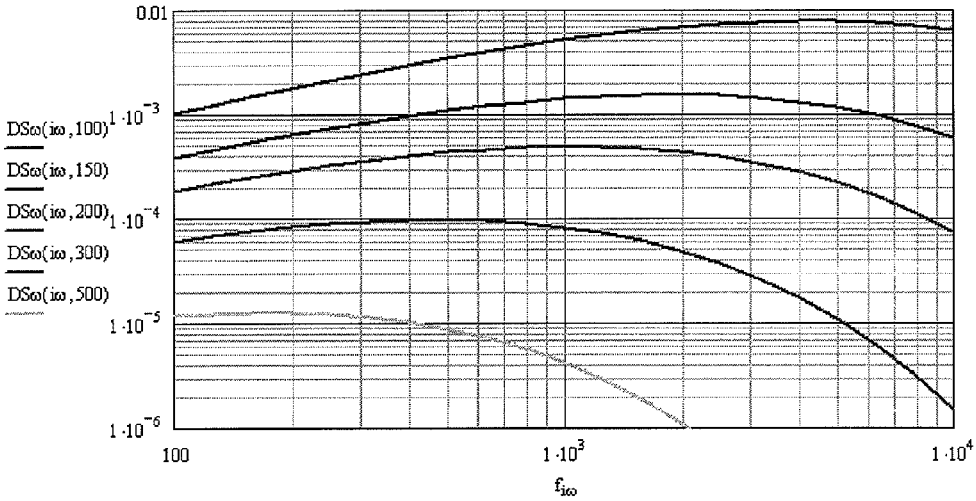
FIG. 4 provides a graph to compare a range of radio frequencies for various through-ground signal transmissions.

Turning now to FIG. 4, there is shown a graph comparing a range of radio frequencies for various through-ground signal transmissions. The graph indicates that there is an optimum frequency for any given distance (soil type remaining constant). The benefit of higher frequency in the detector is offset by the exponentially increasing attenuation due to conductivity in the ground. Other ground or rock type may give variance in these results.

EXAMPLE 5

Method Involving a Master Clock

Figure 5:
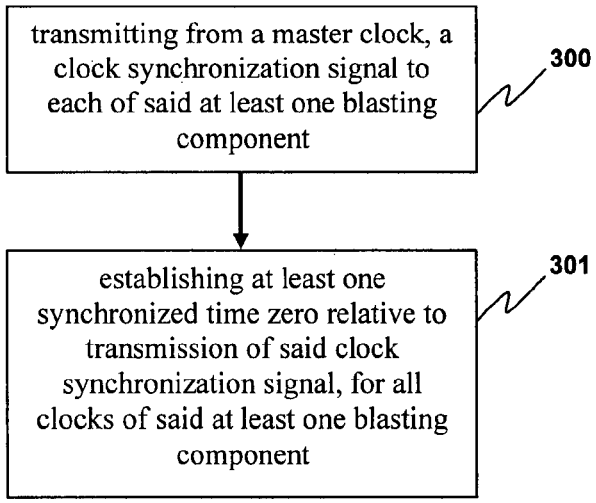
FIG. 5 schematically illustrates a preferred method of the present invention.

A particularly preferred method of the invention will now be described with reference to FIG. 5. This method extends the method described with reference to FIG. 1, to provide a simple alternative means to ensure timed actuation of explosive charges with a high degree of accuracy. In this method, each of the at least one blasting component comprises a clock and a memory for storing a programmed delay time for actuation of the explosive charge, and the method further comprises:

In step 300 transmitting from a master clock, a clock synchronization signal to each of the at least one blasting component, thereby to synchronize all clocks of the at least one blasting component to the master clock; and In step 301 establishing at least one synchronized time zero relative to transmission of the clock synchronization signal, for all clocks of the at least one blasting component. Receipt by the at least one blasting component of a command signal to FIRE, causes each of the at least one blasting component to wait for a next synchronized time zero and then count down its programmed delay time. Once the delay time has completed its countdown, the expiry of the delay time results in actuation of an associated explosive charge, thereby to effect timed actuation of each explosive charge associated with each blasting component, thereby to achieve a desired blasting pattern. In this way, the master clock functions to keep all other clocks of the blasting apparatus "in line" and synchronized. All blasting components of the blasting apparatus are ready to start a blasting sequence at the next time zero effectively specified by the master clock, so that all blasting components achieve a synchronized time zero for commencing delay time countdown.

The master clock may take any form, and be located either remote from the blast site (for example in an office of a blast operator, perhaps in another location or even another country from the blast site). Alternatively, the master clock may be located at or near the blast site, for example as an integral component of one or more blasting machines. In particularly preferred embodiments, the master clock may be suited for synchronizing the clocks of the blasting components via short range communication at the blast site, for example just prior to or following establishing of the blast apparatus through placement of the blasting components (and associated explosive charges). For example, a master clock may communicate with other components of the blast apparatus, at least for the purpose of initial synchronization, via wired or short range wireless communication. A master clock may, in selected embodiments, be associated with a blasting machine, such that blasting components are brought into close proximity with the blasting machine for clock synchronization with the master clock prior to placement at the blast site. Such a method of synchronization may be especially suited to blasting components that are to be placed underground. Alternatively, the master clock may be associated in some way with a logger device, such that a clock of each blasting component is synchronized with the master clock of the logging device after placement at the blast site, for example during a logging process.

The method of the present example is especially suited for underground explosive operations. Through rock communication typically involves the use of low frequency radio waves, for example using signals with a frequency of 20-2500 Hz. Such frequencies are not always suitable for the transmission of complex wireless signals to underground components of a blasting apparatus. Rock layers, water deposits and general signal noise may disrupt the signal transmission process. Selected methods of the present invention allow for the synchronization (or at least the initial synchronization) of clocks associated with blasting components with a master clock prior to underground placement at the blast site. This circumvents the need to transmit important clock synchronization signals through rock or ground layers.

EXAMPLE 6

Method Involving Re-Synchronization to a Master Clock

Although the methods of the invention involve, least in preferred embodiments, the use of high quality crystal clocks, one of skill in the art will appreciate that all clocks may be prone to a degree of inaccuracy and drift relative to one another, or relative to an absolute standard. Preferred embodiments of the invention allow for correction of such drift. Therefore, in further improvements to the methods of EXAMPLE 5 and other methods described herein, the invention allows for clock re-synchronization or correction following the initial synchronization to the master clock. For example, the methods of the invention may further involve the steps of: transmitting from the master clock at least one further clock synchronization signal to the at least one blasting component; and if required, re-synchronizing each clock of the at least one blasting component, in accordance with the at least one further clock synchronization signal, thereby to correct drift between each clock relative to the master clock. In further selected embodiments, the at least one further clock synchronization signal may be transmitted to the at least one blasting component following placement of the at least one blasting component at the blast site. In this way, initial clock synchronization may be achieved via reliable short range communication with the master clock, whereas correction of drift in blasting component clocks may be achieved via longer range wireless communication, for example through rock. In this way, the maintenance of clock synchrony at the blast site after establishment of a blasting array, may rely upon correction of drift, rather than establishment of absolute synchrony without prior reference to a master clock. Where blasting components are placed underground, post-placement communication with the blasting components need only involve command signals such as a signal to FIRE, and if required at least one further clock synchronization signal, in order to maintain synchronicity and to correct drift.

In especially preferred embodiments, the master clock may transmit a plurality of further clock synchronization signals on a periodic basis. In this way, receipt by a blasting component of a command signal to FIRE will cause the blasting component to begin counting down its delay time upon receipt of a next further clock synchronization signal. In effect, receipt of a command signal to FIRE by the at least one blasting component within a predetermined time period between receipt of two consecutive further clock synchronization signals causes a time zero to be established upon receipt of a second of the two consecutive further clock synchronization signals, thereby causing the delay times to count down from the established time zero.

The further clock synchronization signals may be transmitted on a periodic basis, and each blasting component may correct its own clock on the basis of the further clock synchronization signals thereby to keep in line with the master clock. The further clock synchronization signals may be temporally spaced with any time interval to achieve the desired goal. In preferred embodiments, the further clock synchronization signals are transmitted from 1 to 60 seconds apart. In this way, sufficient time is allowed between the signals for receipt and processing of wireless command signals (to be acted upon at the next further clock synchronization signal), and yet the further clock synchronization signals are not so far apart that the safety of the blast operator(s) is/are greatly jeopardized. Nonetheless, in preferred embodiments, the further synchronization signals are from 10 to 30 seconds apart, most preferably about 15 seconds apart. The optimum of about 15 seconds is considered most appropriate, since this time period may be long enough for receipt of command signals between further synchronization signals, and yet tolerable to a blast operator. The applicant appreciates the safety problems that may be presented if the time interval between further synchronization signals (and therefore possible extended delay time between receipt by a blasting component of a command signal to FIRE and a newly established time zero) is greater than 60 seconds. If the delay is too long, a blast operator may consider the blast apparatus to have malfunctioned, and visit the blast site to check the components—this is clearly a scenario to be avoided at all costs, given that the apparatus may still be active for a blasting event. Maintaining a 'small' time interval between further clock synchronization signals is therefore preferred.

In further preferred embodiments, the command signals may only be transmitted by a blasting machine, and/or a blasting component may only be receptive to receive command signals, within a pre-determined time period timed to occur between two consecutive further clock synchronization signals. In this way, a blasting component will know when to "look" for a command signal, or alternatively for a further synchronization signal, to avoid confusion between the two types of signals. Furthermore, the use of such time windows for receipt of command signals may avoid a scenario where a blasting component receives a clock synchronization signal and a command signal to. FIRE at, or virtually at, the same time. After all, the blasting component must, at least in preferred embodiments, be in no doubt as to which further synchronization signal constitutes the "next" synchronization signal from which a time zero is to be established. In other embodiments, the pre-determined time period occurs just prior to or just following receipt of the further clock synchronization signals. If the pre-determined time period for receipt of command signals occurs immediately after receipt of a clock synchronization signal, then any doubt by the blasting component as to which further synchronization signal is the "next" such signal, may be substantially eliminated.

In preferred embodiments, each clock of each blasting component may oscillate with a frequency slightly slower than the master clock, such that correction of drift in all clocks of the at least one blasting component requires a positive correction requiring the clocks to gain time to catch up with the master clock. Alternatively, each clock of each blasting component may oscillate with a frequency slightly faster than the master clock, such that correction of drift in all clocks of the at least one blasting component requires a negative correction to cause the clocks to lose time and fall back into line with the master clock. In either scenario, correction of drift in a single direction may facilitate the correction process.

EXAMPLE 7

Method Involving Resynchronization to a Master Clock, with Bursts of Command Signals The present example describes further improvements to selected methods described with reference to example 6, and other methods described in the present application. In selected embodiments, the invention presents significant advantages by allowing for the transmission of more than one command signal with the same intended purpose (e.g. a command signal to FIRE), whereby receipt by a blasting component of any one or more of such identical command signals will be sufficient to cause the blasting component to properly act upon the command signal. The transmission of multiple identical command signals may be especially useful where the transmission and receipt of the wireless signals is less than reliable, such as for example though rock signal transmission. Therefore, in selected embodiments, a plurality of command signals to FIRE may be transmitted by a blasting machine, and whereupon receipt of any one or more of the plurality of command signals to FIRE by the at least one blasting component causes establishment of a time zero and countdown of delay times upon receipt of a next further clock synchronization signal from the master clock. In effect, this 'brute force' approach attempts to push many command signals through the rock, in the hope that at least one is properly received and delineated by a blasting component, thereby improving the safety of the apparatus and the possibility of a successful blast. The methods of the invention present an opportunity to send multiple identical command signals, since such command signals will not be acted upon immediately, but rather only when another clock synchronization signal is received.

Preferably, the plurality of command signals to FIRE are transmitted in a burst of command signals to FIRE transmitted in rapid succession, the burst timed to start and finish between two consecutive further clock calibration signals. In this way, successful receipt by the at least one blasting component of one ore more of the plurality of command signals to FIRE, causes establishment of a time zero and countdown of delay times upon receipt of the second of two consecutive further clock synchronization signals. Moreover, receipt of multiple command signals before and after receipt of a clock synchronization signal is substantially avoided. More preferably, each burst lasts not longer than 5 seconds, and is timed to occur between the two consecutive further clock synchronization signals.

EXAMPLE 8

Blasting Components with Battery Power Saving

In further preferred embodiments of the methods of the invention, each blasting component comprises a battery for providing power thereto, and is switchable between an "active state" for receipt of the clock synchronization signal, the at least one further clock synchronization signal, and optionally the at least one command signal, and an "inactive state" to conserve battery power. More preferably, the at least one blasting component switches from an active state periodically to receive each of the at least one further clock synchronization signals. More preferably, the at least one command signal is transmitted as required to the at least one blasting component within a pre-determined time period relative to a further clock synchronization signal, and the at least one blasting component is adapted to maintain the active state for each of the pre-determined time periods, thereby to ensure proper receipt of the at least one command signal and the at least one further clock synchronization signals. In this way, the blasting component uses battery power to "listen" for incoming signals only when required, and battery power is conserved when no signal is expected.

EXAMPLE 9

Selected Blasting Apparatuses of the Invention

The present invention further encompasses blasting apparatuses, and blasting components suitable for use, for example, with the blasting apparatuses of the invention. Such blasting apparatuses, and components thereof, are especially adapted for use in connection with the methods of the invention, but may also be suitable for use with other methods of blasting.

For example, the invention further compasses a blasting apparatus designed for conducting the method of any one of claims 7 to 18 (and related embodiments as described herein), but which may also be suitable for use for any other blasting method known in the art. Such a blasting apparatus may comprise:

at least one blasting machine for transmitting the at least one command signal;

a calibration signal generating means for generating a carrier signal having a frequency of from 20-2500 Hz;

at least one blasting component for receiving the at least one command signal and the calibration signal, each blasting component comprising: a detonator comprising a firing circuit and a base charge, an explosive charge being in operative association with the detonator, such that actuation of the base charge via the firing circuit causes actuation of the explosive charge; a transceiver for receiving and/or processing the at least one wireless command signal from the blasting machine and the calibration signal from the calibration signal generating means, the transceiver in signal communication with the firing circuit such that upon receipt of a command signal to FIRE the firing circuit causes actuation of the base charge and actuation of the explosive charge; a clock; a memory for storing a programmed delay time; and delineation means to delineate the oscillations of the calibration signal, or portions of the oscillations, thereby to allow synchronization of all clocks in all blasting components relative to one another, and establishment of a time zero, such that upon receipt by the at least one blasting component of a command signal to FIRE, the delay times counting down from a synchronized time zero thereby to effect timed actuation of each explosive charge associated with each blasting component, thereby to achieve a desired blasting pattern.

In other embodiments of the invention there are provided blasting components for use in connection with, for example, the blasting apparatus described above. Such a blasting component may comprise:

a detonator comprising a firing circuit and a base charge, an explosive charge being in operative association with the detonator, such that actuation of the base charge via the firing circuit causes actuation of the explosive charge;

a transceiver for receiving and/or processing the at least one wireless command signal from the blasting machine and the calibration signal from the calibration signal generating means, the transceiver in signal communication with the firing circuit such that upon receipt of a command signal to FIRE the firing circuit causes actuation of the base charge and actuation of the explosive charge;

a clock;

a memory for storing a programmed delay time; and delineation means to delineate the oscillations of the calibration signal, or portions of the oscillations, thereby to allow synchronization of all clocks in the blasting components relative to one another, and establishment of a time zero, such that upon receipt by the at least one blasting component of a command signal to FIRE, the delay times counting down from a synchronized time zero thereby to effect timed actuation of each explosive charge associated with each blasting component, thereby to achieve a desired blasting pattern. Preferably, the at least one command signal and the calibration signal are wireless signals.

In other embodiments of the present invention there are provided blasting apparatuses for conducting the method of any one of claims 19 to 31 (and related embodiments as described herein), but which may be suitable for use for any other blasting method known in the art. Such a blasting apparatus may comprise:

at least one blasting machine for transmitting the at least one command signal;

a master clock for generating a clock synchronization signal and transmitting the clock synchronization signal to each of the at least one blasting component, thereby to synchronize all clocks of the at least one blasting component; and at least one blasting component for receiving the at least one command signal and the clock calibration signal, each blasting component comprising: a detonator comprising a firing circuit and a base charge, an explosive charge being in operative association with the detonator, such that actuation of the base charge via the firing circuit causes actuation of the explosive charge; a transceiver for receiving and/or processing the at least one wireless command signal from the blasting machine and the clock calibration signal from the master clock, the transceiver in signal communication with the firing circuit such that upon receipt of a command signal to FIRE the firing circuit causes actuation of the base charge and actuation of the explosive charge; a clock; a memory for storing a programmed delay time; and clock calibration means to delineate the clock calibration signal, thereby to synchronize the clock to the master clock, and establish at least one synchronized time zero, such that upon receipt by the at least one blasting component of a command signal to FIRE, each of the at least one blasting component waiting for a next synchronized time zero and then counting down its programmed delay time the expiry of which resulting in actuation of an associated explosive charge, thereby to effect timed actuation of each explosive charge associated with each blasting component, thereby to achieve a desired blasting pattern.

Preferably, the master clock further transmits at least one, further clock synchronization signal to the at least one blasting component, the clock calibration means re-synchronizing each clock of the at least one blasting component if required, in accordance with the at least one further clock synchronization signal, thereby to correct drift between each clock relative to the master clock.

In still further embodiments, the invention provides for a blasting component for use in connection with the blasting apparatus of the invention comprising a master clock, the blasting component comprising:

at least one blasting component for receiving the at least one command signal and the clock calibration signal, each blasting component comprising:

a detonator comprising a firing circuit and a base charge, an explosive charge being in operative association with the detonator, such that actuation of the base charge via the firing circuit causes actuation of the explosive charge;

a transceiver for receiving and/or processing the at least one wireless command signal from the blasting machine and the clock calibration signal from the master clock, and optionally at least one further clock calibration signals from the master clock, the transceiver in signal communication with the firing circuit such that upon receipt of a command signal to FIRE the firing circuit causes actuation of the base charge and actuation of the explosive charge;

a clock;

a memory for storing a programmed delay time; and clock calibration means to delineate the clock calibration signal, thereby to synchronize the clock to the master clock, and establish at least one synchronized time zero, such that upon receipt by the at least one blasting component of a command signal to FIRE, each of the at least one blasting component waiting for a next synchronized time zero and then counting down its programmed delay time the expiry of which resulting in actuation of an associated explosive charge, thereby to effect timed actuation of each explosive charge associated with each blasting component, thereby to achieve a desired blasting pattern. Preferably, the at least one command signal, the clock synchronization signal, and the at least one further clock synchronization signal where present, are wireless signals.

EXAMPLE 10

Methods and Apparatuses Involving Blasting Components that Conserve Battery Power The methods of the present invention include further embodiments in which the blasting components maintain (for the most part) an inactive state to save battery or other internal power, and which periodically switch to a listening state for a limited time period, with sufficient circuitry active so that they can "listen" for signals from other components of the blasting apparatus (such as a blasting machine or master clock).

Effectively, the blasting components are "asleep" at the blast site, but they keep checking-in periodically to see whether it is time to "wake-up" and form an active, fully listening part of the blasting apparatus. A blasting machine, master clock or other component of the blasting apparatus, can effectively cause the blasting components to "wake-up" by transmission of a suitable signal such as an activation signal or clock synchronization signal. However, to ensure the signals are transmitted during a period "listening" by each blasting component, each activation signal or clock calibration signal is preferably timed or preferably has a duration sufficiently long to ensure proper receipt by each blasting component whilst in a listening state.

When a blast operator wishes to execute a blasting event, he/she may cause a blasting machine to transmit an activation signal, or a master clock to transmit a clock calibration signal. Either such signals (or indeed other signals) may be suitable to activate all of the blasting components at the blast site fairly quickly. Preferably, the activation signal or the clock calibration signal is transmitted at a time or has a duration sufficiently long for the blasting components to "listen for" and receive the signal during one of their periodic switches to a listening state. Any clock calibration signal may, of course, also serve to calibrate the clocks of the blasting components to a master clock, as required.

Therefore, the methods of the invention include those in which each blasting component is switchable between a low-power inactive state to preserve battery power, and a listening state to listen for receipt of an activation signal from an associated blasting machine and/or a clock synchronization signal from a master clock. Such methods may further comprising the step of:

periodically switching the blasting component(s) from the inactive state to the listening state for a limited time period, whereupon failure by each blasting component to receive an activation signal and/or a clock synchronization signal whilst in the listening state, causes each blasting component to re-adopt the inactive state, thereby preserving battery power, and whereupon receipt by the blasting component of an activation signal and/or a clock synchronization signal whilst in the listening state, causes each blasting component to adopt an active state suitable for each blasting component to form an active, functional part of the blasting apparatus.

Such methods may further comprise a step of:

transmitting an activation signal from a blasting machine and/or a clock synchronization signal from a master clock at a time or for a time period sufficient to activate each blasting component of the blasting apparatus, thereby to bring each blasting component into an active, functional state suitable for forming an active component of the blasting apparatus. In specific embodiments, the activation signal and/or the clock calibration signal may have a duration longer than a time period between the periodic switching, thereby to ensure each blasting component is in a listening state suitable for receiving the activation signal and/or the clock calibration signal before each blasting component reverts back to an inactive state.

The invention also encompasses corresponding blasting apparatuses for conducting the methods disclosed in this example. Such blasting apparatus may comprise:

at least one blasting machine for transmitting the at least one command signal, and optionally the activation signal to switch the blasting components to an active state to form active components of the blasting apparatus;

optionally a master clock for generating a clock synchronization signal and transmitting the clock synchronization signal to each of the at least one blasting component, thereby to synchronize all clocks of the at least one blasting component to the master clock and/or to switch the blasting components to an active state to form active components of the blasting apparatus; and at least one blasting component for receiving the at least one command signal, if present the clock synchronization signal, and if present the activation signal, each blasting component comprising: a detonator comprising a firing circuit and a base charge, an explosive charge being in operative association with the detonator, such that actuation of the base charge via the firing circuit causes actuation of the explosive charge; a transceiver for receiving and/or processing the at least one wireless command signal from the blasting machine, if present the clock synchronization signal from the master clock, and if present the activation signal, the transceiver in signal communication with the firing circuit such that upon receipt of a command signal to FIRE the firing circuit causes actuation of the base charge and actuation of the explosive charge if the blasting component is in the active state; a clock; a memory for storing a programmed delay time; and switching means for periodically switching each blasting component from the inactive state to the listening state suitable to receive the clock calibration signal or the activation signal.

The invention also provides for: a blasting component for use in connection with the blasting apparatus described above, the blasting component comprising:

a detonator comprising a firing circuit and a base charge;

an explosive charge in operative association with the detonator, such that actuation of the base charge via the firing circuit causes actuation of the explosive charge;

a transceiver for receiving and/or processing the at least one wireless command signal from the blasting machine, if present the clock synchronization signal from the master clock, and if present the activation signal, the transceiver in signal communication with the firing circuit such that upon receipt of a command signal to FIRE the firing circuit causes actuation of the base charge and actuation of the explosive charge if the blasting component is in the active state;

a clock;

a memory for storing a programmed delay time; and switching means for periodically switching the blasting component from the inactive state to the listening state suitable to receive the clock calibration signal or the activation signal.

Whilst the invention has been described with reference to specific embodiments of the methods of communication and methods of blasting of the invention, such embodiments are merely intended to be illustrative of the invention and are in no way intended to be limiting. Other embodiments exist that have not been specifically described which nonetheless lie within the spirit and scope of the invention. It is the intention to include all such embodiments within the scope of the appended claims.

The invention claimed is:

1. A method for wireless communication between at least one blasting machine of a blasting apparatus and at least one blasting component of the blasting apparatus at a blast site for mining, the at least one blasting component comprising or in operative association with an explosive charge, and comprising a clock and a memory for storing a programmed delay time for actuation of the explosive charge, the method comprising the steps of:

transmitting the at least one wireless command signal from the at least one blasting machine, the at least one wireless command signal comprising low frequency radio waves;

receiving the at least one wireless command signal by the at least one blasting component;

processing and to reduce noise optionally amplifying/filtering the received at least one wireless command signal; and optionally acting upon the at least one wireless command signal, as required, wherein the at least one blasting machine or another component of the blasting apparatus transmits:

a calibration signal having a carrier frequency of from 20-2500 Hz;

the step of receiving further comprising delineation of the oscillations of the calibration signal, or portions of said oscillations, thereby to allow synchronization of all clocks in the blasting components relative to one another, and establishment of a time zero, such that upon receipt by said at least one blasting component of a command signal to FIRE, said delay times counting down from a synchronized time zero thereby to effect timed actuation of each explosive charge associated with each blasting component, thereby to achieve a desired blasting pattern.

2. The method of claim 1, wherein each of the at least one blasting component is selected from a wireless detonator assembly, and a wireless electronic booster.

3. The method of claim 1, wherein said at least one command signal is modulated, and the step of receiving includes demodulation of the at least one command signal.

4. The method of claim 3, wherein the at least one command signal undergoes frequency shift key (FSK) modulation, and the step of receiving includes FSK demodulation to reconstruct the at least one command signal.

5. The method of claim 1, wherein the at least one command signal comprises LF radio waves having a frequency of from 20-2500 Hz, preferably from 100-2000 Hz, more preferably from 200-1200 Hz, more preferably about 300 Hz.

6. The method of claim 1, wherein the at least one wireless command signal comprises LF radio waves having a frequency other than about 50 Hz or harmonics thereof, thereby to avoid interference of said at least one command signal by sources of noise operating at 50 Hz or harmonics thereof.

7. The method of claim 1, wherein the at least one command signal is transmitted from said at least one blasting machine to said at least one blasting component through rock.

8. The method of claim 1, wherein each oscillation of the calibration signal comprises zero-crossing times at a beginning and a half-way time for each oscillation, said zero-crossing times establishing reference times to assist in delineation by each of said at least one blasting component of the calibration signal over noise, and wherein further reference times are optionally calculated between the zero-crossing times thereby to increase a temporal resolution of the calibration signal as received by the at least one blasting component.

9. The method of claim 1 wherein the calibration signal has a resolution of less than 1 ms.

10. The method of claim 1, wherein the calibration signal is transmitted continuously.

11. The method of claim 1 wherein the at least one command signal is integrated into the calibration signal by varying the frequency of the calibration signal periodically between at least two frequencies, thereby to introduce binary coding into the calibration signal.

12. A method for blasting rock using a blasting apparatus comprising at least one blasting machine located on or above a surface of the ground for transmitting at least one wireless command signal, and at least one blasting component located below a surface of the ground for receiving and acting upon said at least one wireless command signal, each blasting component including or in operative association with an explosive charge and comprising a clock and a memory for storing a programmed delay time, the method comprising the steps of:

transmitting through rock from each blasting machine or another component of the blasting apparatus a calibration signal having a LF radio wave carrier frequency of from 20-2500 Hz;

receiving though rock the calibration signal by each blasting component;

processing the received calibration signal by:

optionally amplifying and/or filtering the calibration signal to reduce LF noise;

determining from the calibration signal reference times such as zero-crossing times; and optionally calculating further reference times between the reference times;

thereby to establish a synchronized clock count for each blasting component;

transmitting through rock at least one command signal having a LF radio wave frequency of from 20-2500 Hz other than the frequency of the calibration signal;

receiving through rock the at least one command signal by each blasting component; and processing the received at least one command signal optionally with amplifying and/or filtering to reduce LF noise, and acting upon the at least one command signal as required;

whereby, if said at least one command signal includes a signal to FIRE, each clock of each blasting component establishing a synchronized time zero and counting down from said synchronized time zero its own programmed delay time, thereby to effect timed actuation of each explosive charge associated with each blasting component, thereby to achieve a desired blasting pattern.

13. The method of claim 12, wherein each of the at least one blasting component is selected from a wireless detonator assembly, and a wireless electronic booster.

14. The method of claim 12, wherein said at least one command signal and/or the calibration signal is modulated, and each step of receiving includes demodulation of the signal (s).

15. The method of claim 14, wherein the at least one command signal undergoes frequency shift key (FSK) modulation, and the step of receiving includes FSK demodulation to reconstruct the at least one command signal and/or the calibration signal.

16. The method of claim 12, wherein the at least one command signal comprises LF radio waves having a frequency of from 20-2500 Hz, preferably from 100-2000 Hz, more preferably from 200-1200 Hz, more preferably about 300 Hz.

17. The method of claim 12, wherein at least one wireless command signal and/or the calibration signal comprises LF radio waves having a frequency other than about 50 Hz or harmonics thereof, thereby to avoid interference by sources of noise operating at 50 Hz or harmonics thereof.

18. The method of claim 12, wherein prior to receipt of a command signal to FIRE each blasting component is brought into direct electrical contact or short-range wireless communication with a logger, for programming of the blasting component with data selected from one or more of: a delay time, identification information, and a firing code.

19. The method of claim 12, wherein prior to receipt of a command signal to FIRE each blasting component is programmed by through rock wireless signals from a blasting machine or another above-ground component of the blasting apparatus, with data selected from one or more of: a delay time, identification information, and a firing code.

20. The method of claim 1, wherein the calibration signal is a clock synchronization signal transmitted from a master clock to each of said at least one blasting component, thereby to synchronize all clocks of said at least one blasting component to said master clock;

such that upon receipt by said at least one blasting component of a command signal to FIRE, each of said at least one blasting component waiting for a next synchronized time zero and then counting down its programmed delay time.

21. The method of claim 20, wherein said clock synchronization signal is transmitted via short range communication involving either direct electrical contact or short range wireless communication between the master clock and said at least one blasting component, optionally prior to placement of said at least one blasting component at the blast site.

22. The method of claim 20, wherein said placement of said at least one blasting component comprises placement below ground, and said at least one wireless command signal is transmitted from said at least one blasting machine though-rock via LF radio signals having a frequency of from 20-2500 Hz.

23. The method of claim 20, further comprising the steps of:

transmitting from said master clock at least one further clock synchronization signal to said at least one blasting component; and if required, re-synchronizing each clock of said at least one blasting component, in accordance with said at least one further clock synchronization signal, thereby to correct drift between each clock relative to said master clock.

24. The method of claim 23, wherein said at least one further clock synchronization signal is transmitted to said at least one blasting component following placement of said at least one blasting component at said blast site below ground, such that at least said at least one wireless command signal and said at least one further clock synchronization signal are transmitted though rock via LF radio waves having a frequency of 20-2500 Hz.

25. The method of claim 23, said at least one further clock synchronization signal comprising a plurality of further clock synchronization signals transmitted by said master clock periodically, and receipt of at least one command signal to FIRE by said at least one blasting component within a predetermined time period between receipt of two consecutive further clock synchronization signals causes a time zero to be established upon receipt of a second of said two consecutive further clock synchronization signals, thereby causing said delay times to count down from said time zero causing subsequent actuation of explosive charges associated with said at least one blasting component, thereby resulting in a desired blasting pattern.

26. The method of claim 25, wherein said further clock synchronization signals are transmitted from 1 to 60 seconds apart, preferably from 10 to 30 seconds apart, more preferably about 15 seconds apart.

27. The method of claim 23, wherein said at least one command signal to FIRE comprises a plurality of command signals to FIRE transmitted in a burst of command signals transmitted in rapid succession, said burst timed to start and finish between two consecutive further clock calibration signals, such that successful receipt by said at least one blasting component of one ore more of said plurality of command signals to FIRE, causes establishment of a time zero and countdown of delay times upon receipt of said second of said two consecutive further clock synchronization signals.

28. The method of claim 23, wherein each of said at least one blasting component comprises a battery for providing power thereto, and is switchable between an active state for receipt of said clock synchronization signal, said at least one further clock synchronization signal, and optionally said at least one command signal, and an inactive state to conserve battery power.

29. The method of claim 28, wherein said at least one blasting component switches from an active state periodically to receive each of said at least one further clock synchronization signals.

30. The method of claim 29, wherein said at least one command signal is transmitted as required to said at least one blasting component within a pre-determined time period relative to a further clock synchronization signal, and said at least one blasting component is adapted to maintain said active state only for each of said pre-determined time periods, thereby to ensure receipt of said at least one command signal and said at least one further clock synchronization signals, and thereby to conserve battery power when no signal is expected.

31. The method of claim 23, wherein each clock of each blasting component oscillates with a frequency slightly slower than said master clock, such that correction of drift in all clocks of said at least one blasting component requires a positive correction cause said clocks to gain time to catch up with said master clock.

32. The method of claim 23, wherein each clock of each blasting component oscillates with a frequency slightly faster than said master clock, such that correction of drift in all clocks of said at least one blasting component requires a negative correction to cause said clocks to lose time and fall back into line with said master clock.

33. The method of claim 1, wherein each blasting component is switchable between a low-power inactive state to preserve battery power, and a listening state to listen for receipt of an activation signal from an associated blasting machine or other component, and/or a clock synchronization signal from a master clock, the method further comprising the step of periodically switching the blasting component(s) from said inactive state to said listening state for a limited time period, whereupon failure by each blasting component to receive an activation signal and/or a clock synchronization signal whilst in said listening state, causes each blasting component to re-adopt said inactive state, thereby preserving battery power, and whereupon receipt by said blasting component of an activation signal and/or a clock synchronization signal whilst in said listening state, causes each blasting component to adopt an active state suitable for each blasting component to form an active, functional part of said blasting apparatus.

34. The method of claim 33, the method further comprises a step of:

transmitting an activation signal from a blasting machine or other component and/or a clock synchronization signal from a master clock at a time or for a time period sufficient to activate each blasting component of the blasting apparatus, thereby to bring each blasting component into an active, functional state suitable for forming an active component of said blasting apparatus.

35. The method of claim 34, wherein said activation signal and/or said clock synchronization signal has a duration longer than a time period between said periodic switching, thereby to ensure each blasting component is in a listening state suitable for receiving said activation signal and/or said clock synchronization signal before each blasting component reverts back to an inactive state.

36. A blasting apparatus for conducting the method of claim 7 or 12, the blasting apparatus comprising:

at least one blasting machine for transmitting the at least one command signal;

a calibration signal generating means for generating a carrier signal having a frequency of from 20-2500 Hz;

at least one blasting component for receiving said at least one command signal and said calibration signal; each blasting component comprising: a detonator comprising a firing circuit and a base charge, an explosive charge being in operative association with said detonator, such that actuation of said base charge via said firing circuit causes actuation of said explosive charge; a transceiver for receiving and/or processing said at least one wireless command signal from said blasting machine and said calibration signal from said calibration signal generating means, said transceiver in signal communication with said firing circuit such that upon receipt of a command signal to FIRE said firing circuit causes actuation of said base charge and actuation of said explosive charge; a clock; a memory for storing a programmed delay time; and delineation means to delineate the oscillations of the calibration signal, or portions of said oscillations, thereby to allow synchronization of all clocks in the blasting components relative to one another, and establishment of a time zero, such that upon receipt by said at least one blasting component of a command signal to FIRE, said delay times counting down from a synchronized time zero thereby to effect timed actuation of each explosive charge associated with each blasting component, thereby to achieve a desired blasting pattern.

37. A blasting component for use in connection with the blasting apparatus of claim 36, the blasting component comprising:

a detonator comprising a firing circuit and a base charge, an explosive charge being in operative association with said detonator, such that actuation of said base charge via said firing circuit causes actuation of said explosive charge;

a transceiver for receiving and/or processing said at least one wireless command signal from said blasting machine and said calibration signal from said calibration signal generating means, said transceiver in signal communication with said firing circuit such that upon receipt of a command signal to FIRE said firing circuit causes actuation of said base charge and actuation of said explosive charge;

a clock;

a memory for storing a programmed delay time; and delineation means to delineate the oscillations of the calibration signal, or portions of said oscillations, thereby to allow synchronization of all clocks in the blasting components relative to one another, and establishment of a time zero, such that upon receipt by said at least one blasting component of a command signal to FIRE, said delay times counting down from a synchronized time zero thereby to effect timed actuation of each explosive charge associated with each blasting component, thereby to achieve a desired blasting pattern.

38. A blasting apparatus for conducting the method of claim 20, the blasting apparatus comprising:

at least one blasting machine for transmitting the at least one command signal;

a master clock for generating a clock synchronization signal and transmitting the clock synchronization signal to each of said at least one blasting component, thereby to synchronize all clocks of said at least one blasting component to said master clock; and at least one blasting component for receiving said at least one command signal and said clock synchronization signal, each blasting component comprising: a detonator comprising a firing circuit and a base charge, an explosive charge being in operative association with said detonator, such that actuation of said base charge via said firing circuit causes actuation of said explosive charge; a transceiver for receiving and/or processing said at least one wireless command signal from said blasting machine and said clock synchronization signal from said master clock, said transceiver in signal communication with said firing circuit such that upon receipt of a command signal to FIRE said firing circuit causes actuation of said base charge and actuation of said explosive charge; a clock; a memory for storing a programmed delay time; and clock calibration means to delineate the clock synchronization signal, thereby to synchronize said clock to said master clock, and establish at least one synchronized time zero, such that upon receipt by said at least one blasting component of a command signal to FIRE, each of said at least one blasting component waiting for a next synchronized time zero and then counting down its programmed delay time resulting in actuation of an associated explosive charge, thereby to effect timed actuation of each explosive charge associated with each blasting component, thereby to achieve a desired blasting pattern;

said master clock optionally further transmitting at least one further clock synchronization signal to said at least one blasting component, said clock calibration means re-synchronizing each clock of said at least one blasting component if required, in accordance with said at least one further clock synchronization signal, thereby to correct drift between each clock relative to said master clock.

39. A blasting component for use in connection with the blasting apparatus of claim 38, the blasting component comprising:

a detonator comprising a firing circuit and a base charge, an explosive charge being in operative association with said detonator, such that actuation of said base charge via said firing circuit causes actuation of said explosive charge;

a transceiver for receiving and/or processing said at least one wireless command signal from said blasting machine and said clock synchronization signal from said master clock, and optionally at least one further clock synchronization signals from said master clock, said transceiver in signal communication with said firing circuit such that upon receipt of a command signal to FIRE said firing circuit causes actuation of said base charge and actuation of said explosive charge;

a clock;

a memory for storing a programmed delay time; and clock calibration means to delineate the clock synchronization signal, thereby to synchronize said clock to said master clock, and establish at least one synchronized time zero, such that upon receipt by said at least one blasting component of a command signal to FIRE, each of said at least one blasting component waiting for a next synchronized time zero and then counting down its programmed delay time resulting in actuation of an associated explosive charge, thereby to effect timed actuation of each explosive charge associated with each blasting component, thereby to achieve a desired blasting pattern.

40. A blasting apparatus for conducting the method of claim 33, the blasting apparatus comprising:

at least one blasting machine for transmitting the at least one command signal, and optionally said activation signal to switch said blasting components to an active state to form active components of the blasting apparatus;

optionally a master clock for generating a clock synchronization signal and transmitting the clock synchronization signal to each of said at least one blasting component, thereby to synchronize all clocks of said at least one blasting component to said master clock and/or to switch said blasting components to an active state to form active components of the blasting apparatus; and at least one blasting component for receiving said at least one command signal, if present said clock synchronization signal, and if present said activation signal, each blasting component comprising: a detonator comprising a firing circuit and a base charge, an explosive charge being in operative association with said detonator, such that actuation of said base charge via said firing circuit causes actuation of said explosive charge; a transceiver for receiving and/or processing said at least one wireless command signal from said blasting machine, if present said clock synchronization signal from said master clock, and if present said activation signal, said transceiver in signal communication with said firing circuit such that upon receipt of a command signal to FIRE said firing circuit causes actuation of said base charge and actuation of said explosive charge if said blasting component is in said active state; a clock; a memory for storing a programmed delay time; and switching means for periodically switching each blasting component from said inactive state to said listening state suitable to receive said clock calibration signal or said activation signal.

41. A blasting component for use in connection with the blasting apparatus of claim 40, the blasting component comprising:

a detonator comprising a firing circuit and a base charge;

an explosive charge in operative association with said detonator, such that actuation of said base charge via said firing circuit causes actuation of said explosive charge;

a transceiver for receiving and/or processing said at least one wireless command signal from said blasting machine, if present said clock synchronization signal from said master clock, and if present said activation signal, said transceiver in signal communication with said firing circuit such that upon receipt of a command signal to FIRE said firing circuit causes actuation of said base charge and actuation of said explosive charge if said blasting component is in said active state;

a clock;

a memory for storing a programmed delay time; and switching means for periodically switching said blasting component from said inactive state to said listening state suitable to receive said clock calibration signal or said activation signal.

* * * * *